US010135122B2

(12) United States Patent
Apostolos et al.

(10) Patent No.: US 10,135,122 B2
(45) Date of Patent: Nov. 20, 2018

(54) SUPER DIRECTIVE ARRAY OF VOLUMETRIC ANTENNA ELEMENTS FOR WIRELESS DEVICE APPLICATIONS

(71) Applicant: AMI Research & Development, LLC, Windham, NH (US)

(72) Inventors: John T. Apostolos, Lyndeborough, NH (US); William Mouyos, Windham, NH (US)

(73) Assignee: AMI RESEARCH & DEVELOPMENT, LLC, Windham, NH (US)

( * ) Notice: Subject to any disclaimer, the term of this patent is extended or adjusted under 35 U.S.C. 154(b) by 0 days.

(21) Appl. No.: 15/362,988

(22) Filed: Nov. 29, 2016

(65) Prior Publication Data

US 2018/0151947 A1 May 31, 2018

(51) Int. Cl.

| | |
|---|---|
| ***H01Q 1/52*** | (2006.01) |
| ***H01Q 1/24*** | (2006.01) |
| ***H01Q 5/48*** | (2015.01) |
| ***H01Q 21/24*** | (2006.01) |
| ***H01Q 1/36*** | (2006.01) |

(52) U.S. Cl.

CPC ..... *H01Q 1/245* (2013.01); *H01Q 1/36* (2013.01); *H01Q 5/48* (2015.01); *H01Q 21/245* (2013.01); *H01Q 1/243* (2013.01)

(58) Field of Classification Search

CPC ..... H01Q 1/241–1/244; H01Q 1/246; H01Q 1/523; H01Q 3/446; H01Q 3/2617; H01Q 3/2647; H01Q 5/378; H01Q 5/385; H01Q 5/392; H01Q 5/49; H01Q 5/42; H01Q 19/005; H01Q 21/26; H01Q 21/293; H01Q 21/296; H01Q 21/065

See application file for complete search history.

(56) References Cited

U.S. PATENT DOCUMENTS

| | | | | |
|---|---|---|---|---|
| 5,231,407 | A | 7/1993 | McGirr et al. | |
| 5,463,406 | A | 10/1995 | Vannatta et al. | |
| 5,606,332 | A | 2/1997 | Darden, IV et al. | |
| 6,057,802 | A * | 5/2000 | Nealy | H01Q 9/0407 343/700 MS |
| 6,404,391 | B1 * | 6/2002 | Apostolos | H01Q 1/38 343/700 MS |
| 6,762,723 | B2 | 7/2004 | Nallo et al. | |
| 6,873,294 | B1 | 3/2005 | Anderson et al. | |
| 7,633,076 | B2 | 12/2009 | Huppi et al. | |
| 8,362,957 | B2 | 1/2013 | Lehtola et al. | |

(Continued)

FOREIGN PATENT DOCUMENTS

EP 2 023 436 A1 2/2009

OTHER PUBLICATIONS

Orr, William I., The Radio Handbook, 15th Edition, Editors and Engineers, Summerland, CA 1959, p. 504.

(Continued)

*Primary Examiner* — Hoang Nguyen
*Assistant Examiner* — Awat Salih
(74) *Attorney, Agent, or Firm* — VLP Law Group, LLP

(57) ABSTRACT

Antenna arrays that provide directive radiation over multiple frequencies, multiple polarizations, and/or operate in modes that reduce unnecessary radiation into a nearby human body. The arrays are particularly adapted for use with handheld wireless devices, such as smartphones, tablets, and cellular phones.

22 Claims, 26 Drawing Sheets

(56) References Cited

U.S. PATENT DOCUMENTS

| | | | | |
|---|---|---|---|---|
| 8,754,817 | B1 * | 6/2014 | Kuo | H01Q 1/243 343/700 MS |
| 8,988,303 | B1 | 3/2015 | Apostolos et al. | |
| 8,989,665 | B2 | 3/2015 | Geris et al. | |
| 9,013,360 | B1 | 4/2015 | Apostolos et al. | |
| 9,118,116 | B2 | 8/2015 | Apostolos et al. | |
| 9,147,936 | B1 | 9/2015 | Apostolos et al. | |
| 9,166,301 | B2 | 10/2015 | Apostolos et al. | |
| 2003/0184492 | A1 | 10/2003 | Chiang et al. | |
| 2004/0037052 | A1 | 2/2004 | Wu et al. | |
| 2004/0046694 | A1 * | 3/2004 | Chiang | H01Q 1/242 342/360 |
| 2004/0090389 | A1 * | 5/2004 | Jo | H01Q 21/26 343/797 |
| 2008/0316098 | A1 * | 12/2008 | Mitsui | H01Q 1/243 342/368 |
| 2009/0075606 | A1 | 3/2009 | Shtrom et al. | |
| 2012/0206302 | A1 * | 8/2012 | Ramachandran | H01Q 1/24 343/702 |
| 2012/0214422 | A1 | 8/2012 | Shi et al. | |
| 2014/0009355 | A1 | 1/2014 | Samardzija et al. | |
| 2014/0035792 | A1 | 2/2014 | Schadler et al. | |
| 2014/0078007 | A1 | 3/2014 | Abe | |
| 2015/0050964 | A1 | 2/2015 | Gorilovsky et al. | |

OTHER PUBLICATIONS

International Search Report and Written Opinion dated Apr. 5, 2018 for Related PCT/US17/63559.

* cited by examiner

801–B

801–A

| Switch Positions | | Polarization | Propagation Direction |
|---|---|---|---|
| 2 | 1 | $H_{pol}$<br>$V_{pol}$ | →<br>↑ |
| 1 | 2 | $H_{pol}$<br>$V_{pol}$ | ↑<br>→ |
| 90° | 90° | RH $C_{pol}$ | |
| -90° | -90° | LH $C_{pol}$ | |

| Feed 1 Info | Feed 2 Info | Mode |
|---|---|---|
| +/- | +/- | $V_{pol}$ |
| +/- | -/+ | $H_{pol}$ |
| +/- | +/- 90° | $V_{pol} < 90°$ RH |
| +/- | -/+ | $H_{pol}$ |
| +/- | +/- | $V_{pol}$ LH |
| +/- | -/+ 90° | $H_{pol} < 90°$ |

FIG. 9H

SUPER DIRECTIVE ARRAY OF VOLUMETRIC ANTENNA ELEMENTS FOR WIRELESS DEVICE APPLICATIONS

BACKGROUND

Technical Field

This application relates to wireless communication and in particular to a device that includes an array of volumetric antenna elements.

Background Information

An important consideration in the design of a wireless device is the antenna. The operating frequency, bandwidth, size constraints, and likelihood of perturbation by the surrounding environment often dictate the antenna configuration. Handheld wireless devices such as cellular telephones have typically used a monopole antenna. However, the gain of a monopole antenna is noticeably reduced by the proximity of a nearby human user. Monopole antennas can only operate efficiently in one mode. They cannot, for example, be optimized to resonate in two different radio frequency bands. Another increasingly important consideration which monopoles cannot accommodate is the need to operate with more than one polarization.

Implementing directivity in an antenna can also be quite useful. A directional antenna, or beam antenna, radiates or receives greater power in one or more specified directions. Directional antennas thus allow for increased performance and reduced interference from unwanted sources. One way to implement a directional antenna is with a phased array. A phased array includes a number of geometrically arranged radiating elements with a deliberate phase relationship. Phase shifts applied to the different elements are varied in order to steer the beam's directional pattern without the use of moving parts. So-called smart antennas are another application of phased arrays, where a digital signal processor may compute phase shifts on the fly.

Government regulatory authorities such as the United States Federal Communications Commission (FCC) specify a maximum Specific Absorption Rate (SAR) for radiation emitted from wireless devices. Such regulations, as well as a general concern over potentially adverse health effects resulting from concentrated radio frequency emissions, have limited the widespread adoption of directional antennas. Smart phones, tablets, and similar wireless devices must of course comply with established radio frequency emission limits.

Recent developments in Internet of Things (IoT) devices presage a future where billions of objects have access to the Internet via wireless networks. The ever present push for internetworking physical devices, vehicles, buildings and other items that have embedded electronics, software, sensors, and actuators will enable many different types of objects to is collect and exchange data. The expected proliferation of these IoT devices has been estimated to reach almost 50 billion objects by the year 2020. This trend will increasingly demand that wireless devices selectively communicate, to avoid unnecessary interference, and reduce competition for use of the limited available wireless spectrum.

SUMMARY

The antenna solution(s) described herein provide directive radiation over multiple frequencies, multiple polarizations, and/or operate in modes that reduce unnecessary radiation into a nearby human body.

In one embodiment, a directive antenna array is disposed within a wireless device. The wireless device may include a rectangular housing with a front face, a back face, and four sides or edges. The device may be of the familiar "bar" form factor such as an Apple™ iPhone™ or Android™ smartphone. Along the four sides of the housing are placed one or more volumetric antenna elements. In one configuration, a set of three volumetric antenna elements are disposed along or near each of the four sides. The volumetric elements may each circumscribe a three-dimensional space. In one design, the volumetric elements may each be a planar, conductive, material patch. The conductive material patch may be of a size, for example, to operate efficiently at Fourth-Generation (4G) wireless frequencies. In other implementations, the volumetric elements may have other shapes, such as a cylinder. These other shapes may be preferable for operation with Fifth-Generation (5G) wireless systems.

The radiating elements may have various physical configurations and may be tuned in particular ways. For example, rectangular patch elements may be folded over onto or near the front and back faces in a "u" shape to conform to the housing. In that configuration, the radiating elements circumscribe a volume that not only encompasses a space along the edge of the housing, but also encompasses a space that reaches into the body of the device. The rectangular patches may also be notched or skewed on one or is more ends. The notches provide a more nearly orthogonal geometry along one or more diagonal axes. These skewed elements provide improved operation when the patches are paired to implement a pair of crossed dipoles.

The radiating elements may be tuned in several different ways. For example, one or more meander lines may connect the front and side conductive patches located on the side with other conductive patches located on the front and/or the back. The meander lines may be used to tune a resonant frequency of the antenna. The meander lines may be tuned by switchable shorting lines, and/or the use of other structures such as Variable Impedance Transmission Lines (VITLs). In still other arrangements, capacitors may be disposed between the meander lines and the front or back conductive surfaces to selectively enable or disable the respective antenna element.

In other aspects the antenna elements may be connected as a driven element or a parasitic element. In one such implementation, three volumetric elements are disposed on each side of the housing, the center element is a driven element, and parasitic elements are placed on either side of the center driven element. In this implementation, the parasitic elements may be controllable to be reflective or directive, such as by tuning their respective resonant frequencies lower or higher than the center driven element. Selectively driving the parasitic elements may also provide Multiple Input/Multiple Output (MIMO) operation.

In other implementation, the three volumetric elements may each be a driven element. This arrangement may use several different feedline configurations depending on desired performance and packaging constraints.

In some arrangements, the elements may each be a pair of crossed dipoles, or even two or more pairs of crossed dipoles. In these implementations, the crossed dipoles may be coupled to combining circuit that can selectively provide different polarizations. Circular, horizontal, and/or vertical polarizations may be provided by selectable feed is networks.

An operating polarization may be selected depending upon detected operating conditions. For example, a control circuit may check to see which polarization mode provides the greatest receive signal strength, and then set the array to operate in that mode. In still other implementations, circuitry may detect whether the wireless device is in motion, relatively stationary, or in an urban or rural operating environment. These operating conditions may be detected by obtaining location information available from a Global Positioning System (GPS) and referencing a map, or by sensors such as motion sensors or accelerometers. If the device is in motion, the array may operate with circular polarization. An urban location may also be identified by sweeping the array to determine if there is multipath indicated by relatively strong signals received in more than one direction. When it is concluded that the device is located in an urban environment, a vertical polarization mode may be selected. When multipath is not detected, the array elements may be selected in a horizontal polarization mode.

In still other implementations, the radiating elements may comprise a circular array where each element is a volumetric cylinder. The cylindrical elements may each be configured as a set of four quadrant radiators connected to provide a pair of crossed dipoles. Arrays of cylindrical elements may be placed on one or both sides of a substrate. In addition, the circular array may have a single driven center element, with the surrounding peripheral elements being parasitic. These embodiments which use cylindrical elements may be preferred for operation in 5G wireless frequency bands.

In a further extension of this arrangement, an array of circular arrays may be provided.

The directive array may also be controlled to minimize directive radiation emissions into a user's body. Optimal orientation of the antenna beam can be selected with respect to both the position of a nearby human and the location of designated receiving location such as a base station, WiFi access point, or paired wireless device. For example, people is tend to hold a cellular phone about their head and/or body when using it, exposing themselves to radiation. Sometimes, placing the device on a table or elsewhere exposes other people to radiation. Therefore, in certain embodiments, receive signal measurements or other information is used to detect a relative position of the device, a nearby human, and an expected receiving station. The directional array is then operated in a mode to steer away from the human; if that is not possible, then an omnidirectional mode is selected.

BRIEF DESCRIPTION OF THE DRAWINGS

The description below refers to the accompanying drawings, of which:

FIG. 9H is a table illustrating how to control polarization for the embodiments of FIGS. 9A to 9G;

DETAILED DESCRIPTION OF ILLUSTRATIVE EMBODIMENTS

Figure 1:
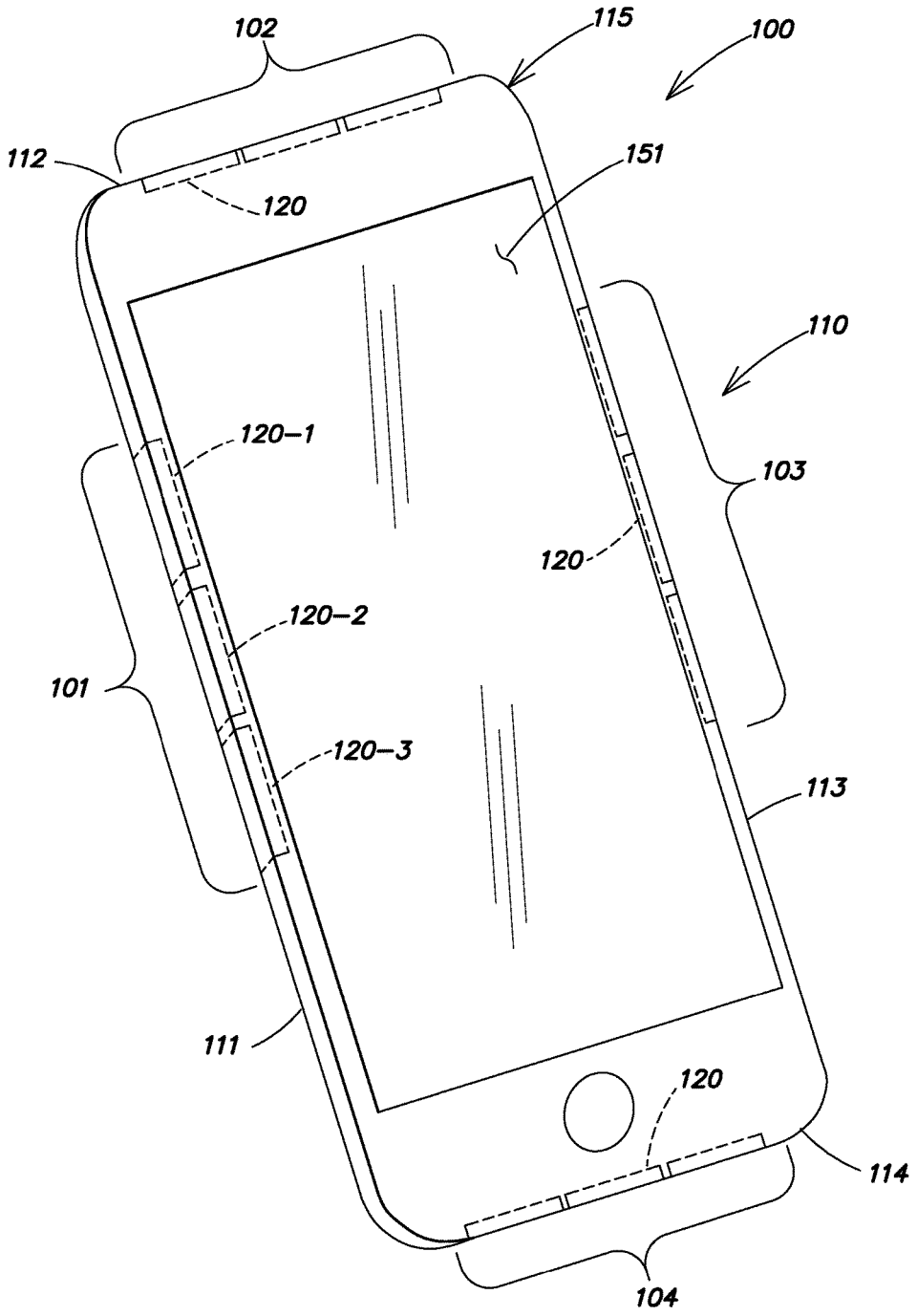
FIG. 1 depicts a smartphone device with four groups of three element line arrays.

FIG. 1 is a front plan view of a wireless communication device 100 such as a cell phone, smart phone, tablet, personal digital assistant, or similar handheld portable communication device. The device 100 is expected to typically operate among two, three, four, or even more frequency bands and wireless protocols such as those associated with Fourth-Generation (4G) wireless systems, Wi-Fi, Bluetooth, Global Positioning System (GPS) and/or Fifth-Generation (5G) wireless. The typical handheld, relatively small size of devices 100 (a few inches on each side) makes it difficult to provide increased antenna gain. Described herein is a way to improve antenna operation using super directive end fire arrays of volumetric patch antennas conforming to the periphery of the device 100, or where cylindrical array elements are disposed within the interior of the device 100.

In the illustrated embodiment, four groups of three radiating elements are disposed around the periphery. In particular, the antenna array 110 consists of four line arrays 101, 102, 103, 104 disposed on along the left edge 111, top edge 112, right edge 113 and bottom edge 114 of a housing 115 for the device 100. An example line array 101 consists of three planar patch elements 120-1, 120-2, and 120-3 disposed along approximately 2.4 inches of space close to a respective edge of the housing 115. This configuration may be suitable for operation in the 4G band, that is, including approximately 700 MHz, 800 MHz, 850 MHz and 1700/2100 MHz radio frequencies.

Each line array is composed of both driven and parasitic elements. In the illustrated configuration, the center element 120-2 is a driven element and elements 120-1 and 120-3 disposed on either side thereof are parasitic.

Figure 2A:
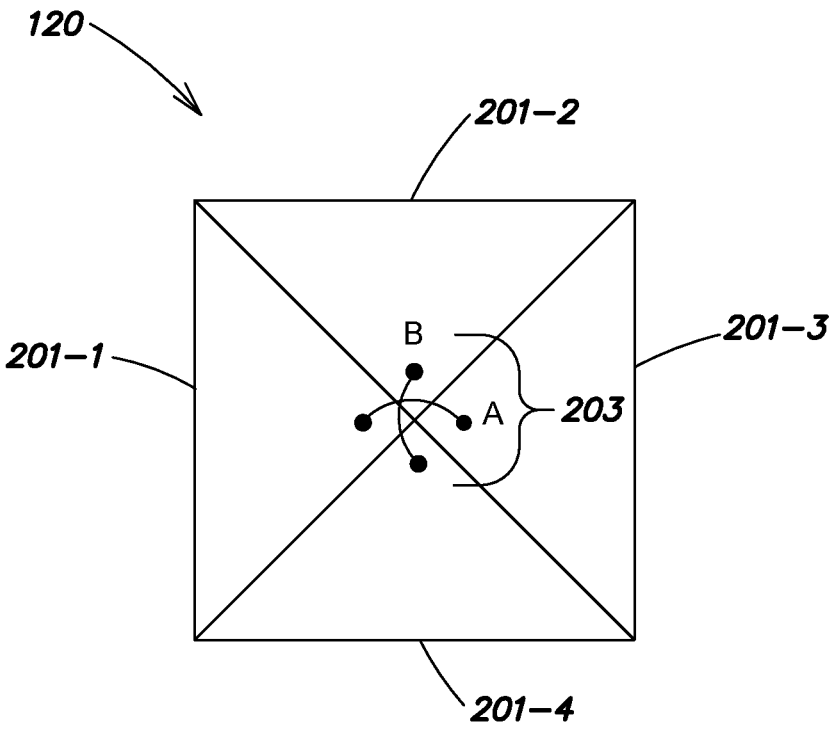
FIGS. 2A, 2B and 2C illustrate crossed dipole elements and beam patterns for the antenna of FIG. 1.
Figure 2C:
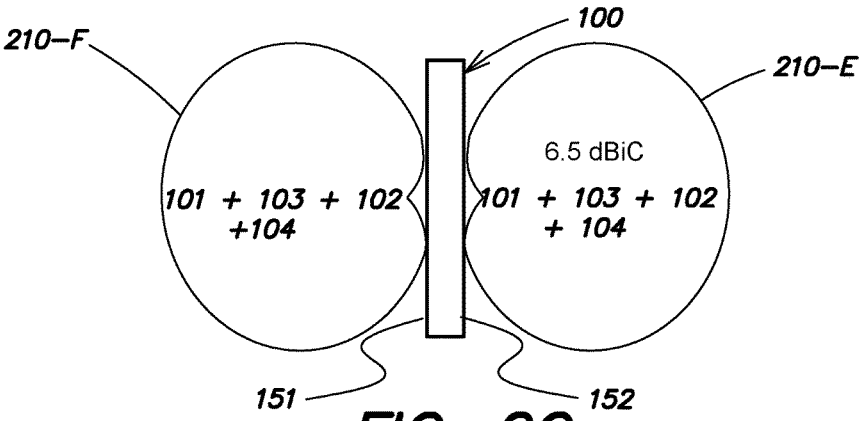
Figure 2B:
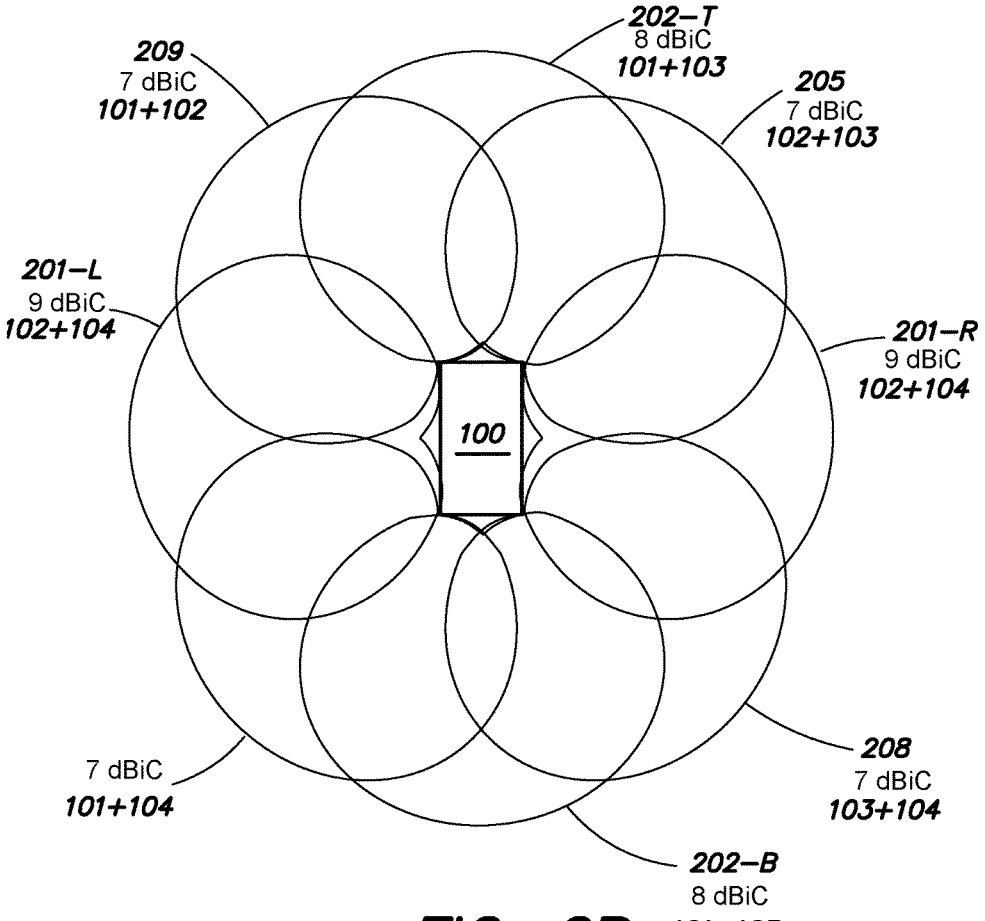

Combinations of selected ones of the four groups of arrays may be used to generate antenna beams in different directions. This is illustrated in FIGS. 2A, 2B and 2C. FIG. 2A shows one implementation where each element 120 may be an Orientation Independent (ORIAN) radiator consisting of a pair of crossed dipoles formed from four patch elements patches. Here each of the four patches 201-1, 201-2, 201-3 and 201-4 is metal surface disposed on an insulating (dielectric) substrate. A feed point such as 203 is provided on each radiator. The feed points may be connected in an A,B pair to provide the pair of crossed dipoles. These A,B feedpoints are then connected to a radio transceiver. Examples of ORIAN elements are described in our other patents such as U.S. Pat. Nos. 8,988,303 and 9,013,360, assigned to AMI Research and Development, LLC, which are hereby incorporated by reference.

FIG. 2B is a front plan view of device 100 and is an example of a family of radiating beams that can be generated by activating selected arrays of FIG. 1 in pairs. For example, horizontal end-fire beams 201-R and 201-L may be generated to the left and the right sides of the device 100 by combining the outputs of arrays 102 and 104 on the top and bottom edge and shorting out (or otherwise deactivating) the other arrays 101 and 103 on is the left and right sides. Beams 202-T and 202-B may be activated by combining the outputs of arrays 101 and 103, while shorting out arrays 102 and 104. A beam 205 generally in a direction of the top right can be generated by combining the outputs of arrays 102 and 103. Similarly, beam 208 can be provided by arrays 103 and 104; beam 209 can be provided by arrays 101 and 102, and so forth. Expected gain is shown within each beam. As explained in more detail below, the arrays can be activated or shorted out with capacitive circuits controlled by switches.

FIG. 2C is a side view showing how vertical broadside beams can be generated by combining the outputs of arrays 101, 102, 103 and 104. This generates broadside beams 210-F and 210-R projecting from the front face 151 and back face 152 of the device 100, respectively.

Figure 3:
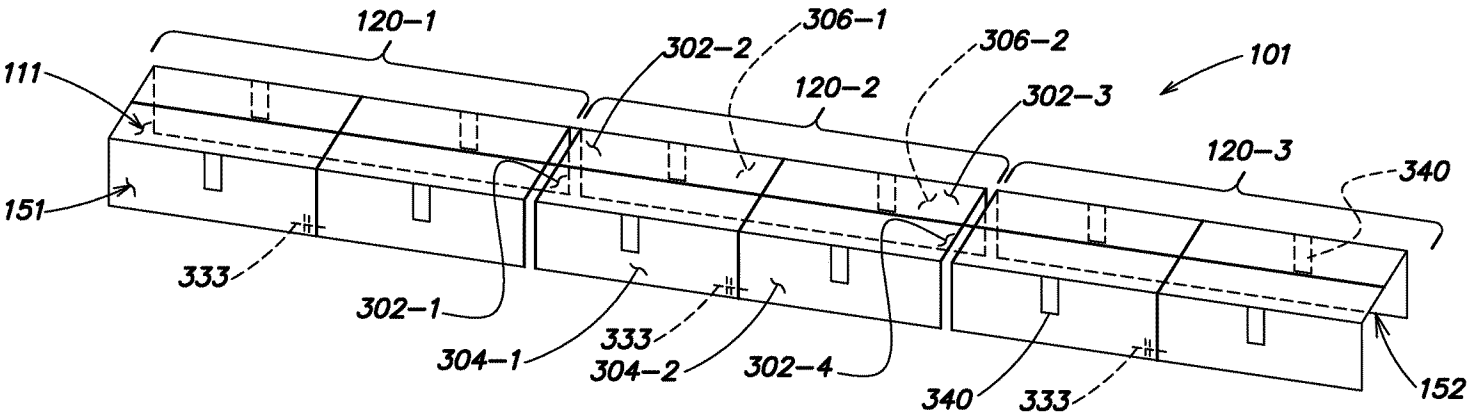
FIG. 3 is a more detailed view of a three-element section of the array.

FIG. 3 is a more detailed view of one example three-element line array 101, which was the array disposed on the left-hand side 111 of the housing 115 in FIG. 1. As explained previously, this particular line array 101 consists of a center driven element 120-2 and two parasitic elements 120-1 and 120-3 disposed on either side thereof. The four patches 302 along the side 111 provide a pair of crossed dipole elements. In this implementation, example driven element 120-2 actually consists of eight patches including four patches 302-1, 302-2, 302-3, 302-4 positioned along the adjacent left side 111 of the housing 115, and two patches adjacent each of the front 151 and back 152 faces, including patches 304-1, 304-2 adjacent the front face 151 and patches 306-3, 306-4 adjacent the back face 152.

The three elements 102 are connected to a transceiver (not shown) by transmission lines, not by parasitic coupling. The elements themselves may be loop-like structures which are inherently low impedance structures not affected by the relatively high hand impedance. The main effect of the presence of a nearby hand is attenuation of the radiated signal. Considering the average thickness of a hand, and the measured attenuation of hands at these frequencies, indicates about 1.2 dBci loss.

A loop-like structure may be realized by connecting patches 304-1 and 304-2 of element 120-2 with a small capacitance across the gap at the bottom of element 120-2. Thus, optional capacitances 333 may be disposed between patches 304-1, 304-2 and element 120-2. Similar capacitances may be provided between patches 306-1, 306-2 on the back side as well as for the other elements 120-1, 120-3.

Parasitic elements 120-1 and 120-3 are constructed from similarly arranged conductive patches.

Figure 4:
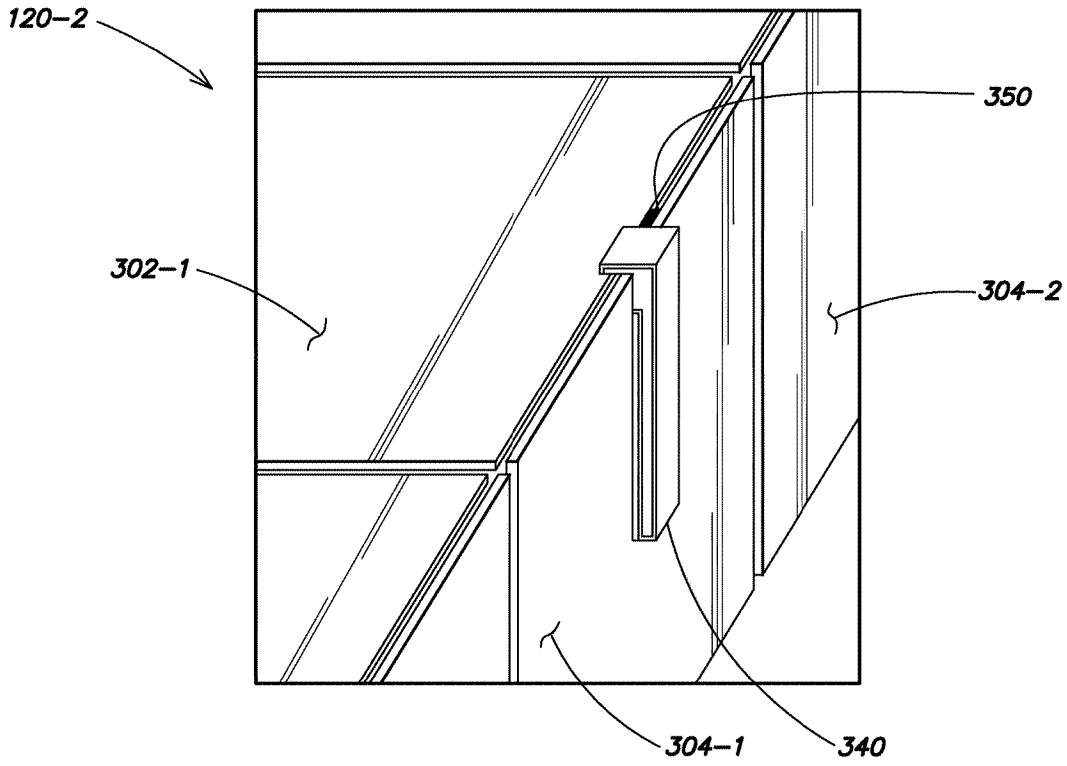
FIG. 4 shows a meander line connecting a side and front patch.

FIG. 4 is a more detailed view of element 120-2 showing patches 304-1, 304-2 adjacent the front face and patch 302-1 adjacent the side. A meander line 340 is connected between patches 302-1 and 304-1 in this embodiment. In some implementations, the delay presented by meander line 340 can be changed, thereby altering the resonant frequency of the element 102-2.

In addition, a capacitor 350 may be disposed between patches 302-1 and 304-1. Capacitor 350 is switchable—that is, a switch (not shown in FIG. 4) controls whether capacitor 350 is dis-connected between patches 302-1 and 304-1 thereby disabling that element (by "detuning" that sub-array element), or if a connection between them is made to thereby enable that element to radiate. For the parasitic elements 102-1, 102-3 the four side patches may be selectively shorted to their respective adjacent top and bottom patches As for the driven element 102-2, switchable capacitors 350 in the parasitic elements 102-1, 102-3 may also assist with providing selective operation to steer the array.

Figure 5:
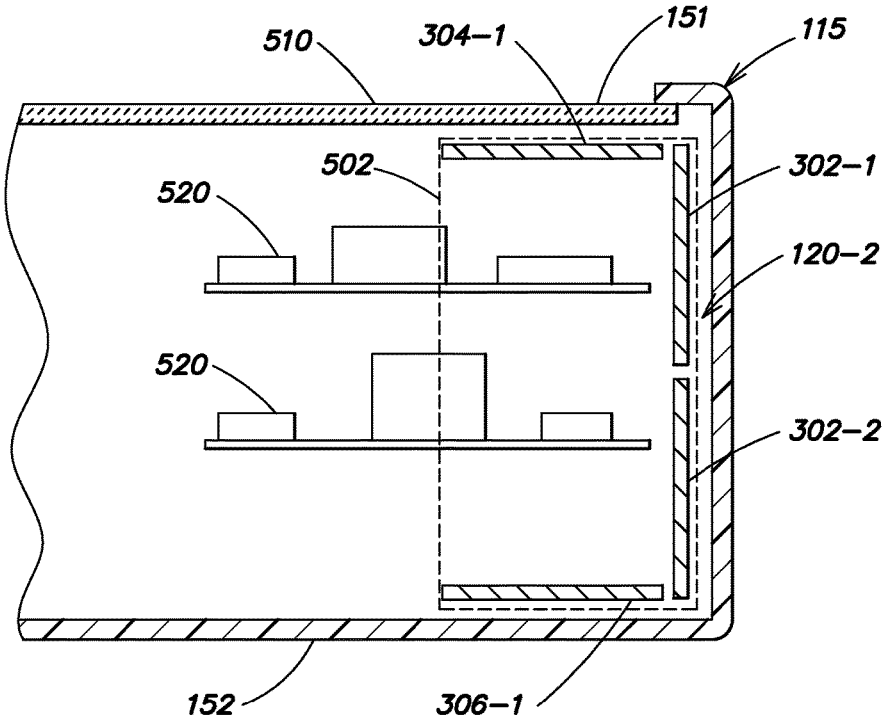
FIG. 5 is a cut away side view.

FIG. 5 is a cross-sectional view of device 100 also showing element 120-2. As mentioned previously, element 120-2 includes a patch 302-1 disposed along or adjacent the side 111 of housing 115, patch 304-1 disposed along or adjacent the front face 151, and patch 306-1 disposed along or adjacent the back face 152. The housing 115 encloses various is components 520 within its front face 151, side 111 and back 152. A touchscreen 510 is typically disposed on, or as part of, the front face 151. Element 120-2 is "volumetric" in the sense that a three dimensional space is circumscribed, as indicated by dotted lines 502, and as defined by the extent of by patches 304-1, 302-1 and 306-1. Components 520 may be located within the space 502 without adversely affecting the operation of the element 120-2. In this way, the limited area available within the housing 115 may be optimized for packaging other components in addition to the antenna array(s).

Figure 6B:
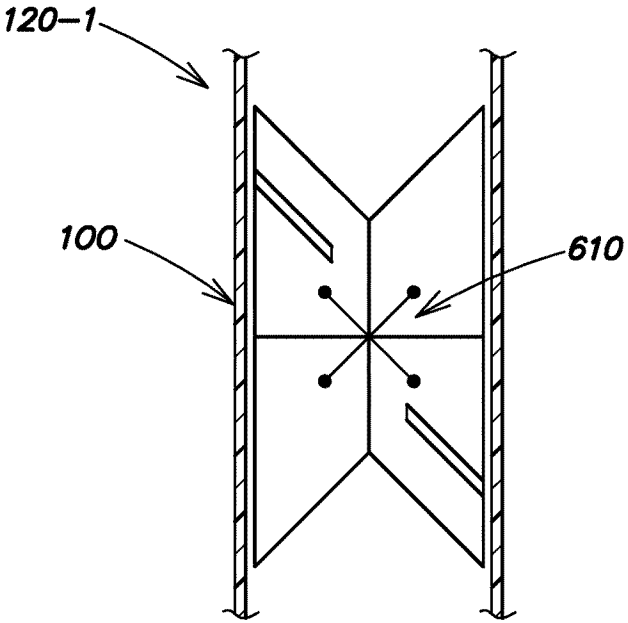
FIGS. 6A, 6B and 6C show another crossed dipole arrangement and connection of capacitors and a meander line.
Figure 6A:
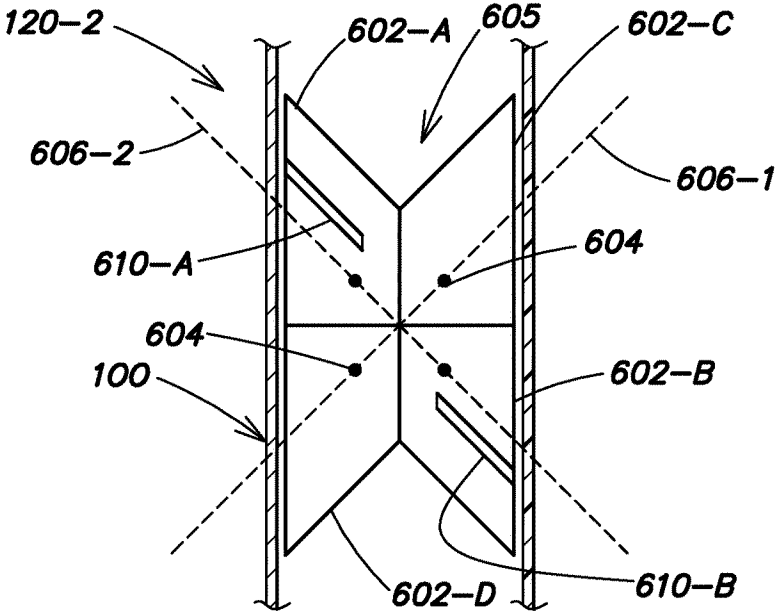

FIG. 6A is a cut away side view of the device 100 showing another example of a driven element 120-2. This driven element 120-2 includes a first pair of skewed patches 602-A, 602-B and a second pair of skewed patches 602-C, 602-D. Feed points 604 for each patch are disposed where the four patches meet—generally in the center. The patches are "skewed" in the sense that a triangular section 605 of the conductive patch is not present. This skewed shape helps provide a more symmetric shape, along diagonal axes 606-1, 606-2, effecting a more orthogonal dipole-like structure as a result. The driven elements are driven at feed points 604 in a manner which can control polarization, as described elsewhere herein.

An example passive element 120-1 is shown in FIG. 6B. It is similar in construction to driven element 120-2—however, the four feed points 610 are shorted together in order to provide the parasitic configuration. Note that in both implementations of FIGS. 6A and 6B, meander line(s) 340 are also placed along at least one skewed patch, as in the other element implementation of FIG. 3.

Figure 6C:
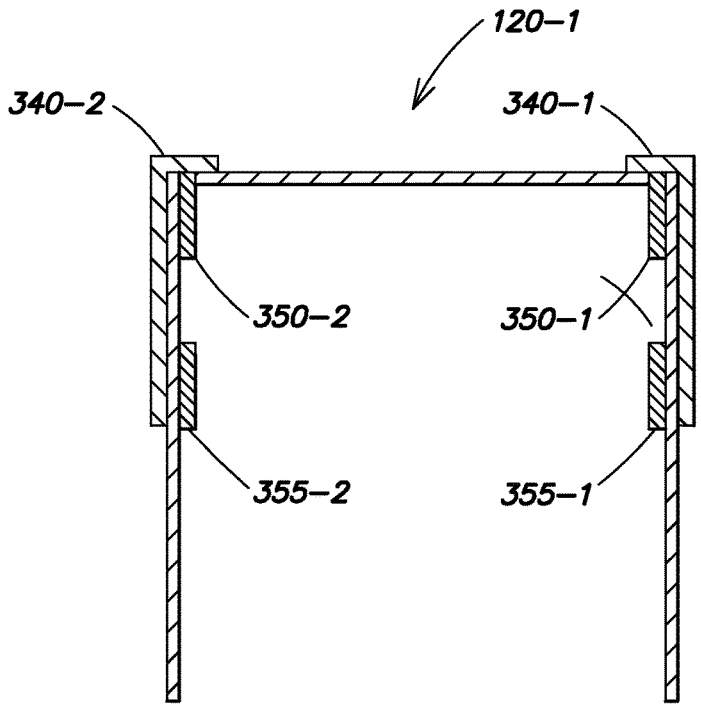

FIG. 6C is a cross-sectional view of a parasitic element 120-1 showing the interconnection of a meander line 340 and one or more capacitors 350-1, 350-2 in more detail. The capacitors 350-1, 350-2 may be further used in tuning the passive element to either be directive or reflective. In particular embodiments, one of the parasitic elements in each array may be tuned to be directive and the other parasitic element may be tuned to be reflective. Capacitors are thus switched in or out to change the resonant frequency of the is element 120-1.

The meander lines assist with tuning each element via switchable shorting lines. Thus, the elements of array 110 each consist of two crossed, skewed dipoles that wrap around the edge of the device 100. A capacitor and/or inductive delay structure, such as a meander line, may be connected or coupled to or among the elements. The meander line structure(s) further allow the element to be tuned to different frequencies. This design enhances instantaneous bandwidth, and also allows the array 110 to approach the Chu-Harrington limit on the Q factor of a small antenna.

Figure 6D:
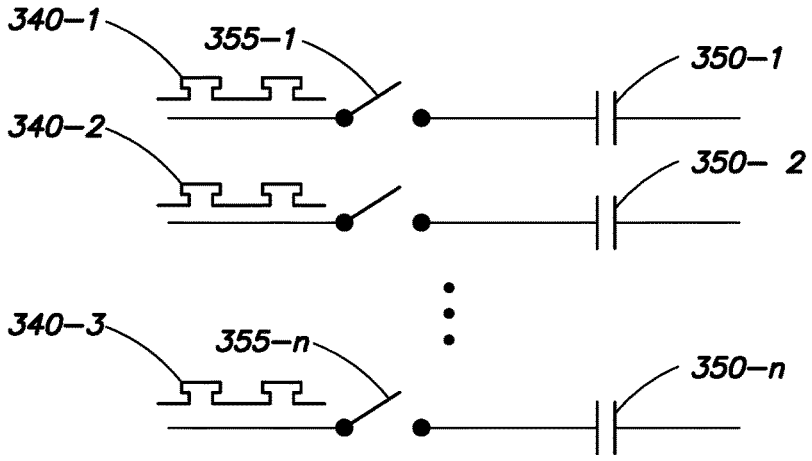
FIG. 6D shows switchable capacitors to select tuned sub-bands.

FIG. 6D shows an arrangement of switches 355 which may be used to control whether capacitors 350-1, 350-2, . . . **350-*n* in FIG. 6C are connected to the respective meander lines 340** or not.

Figure 7B:
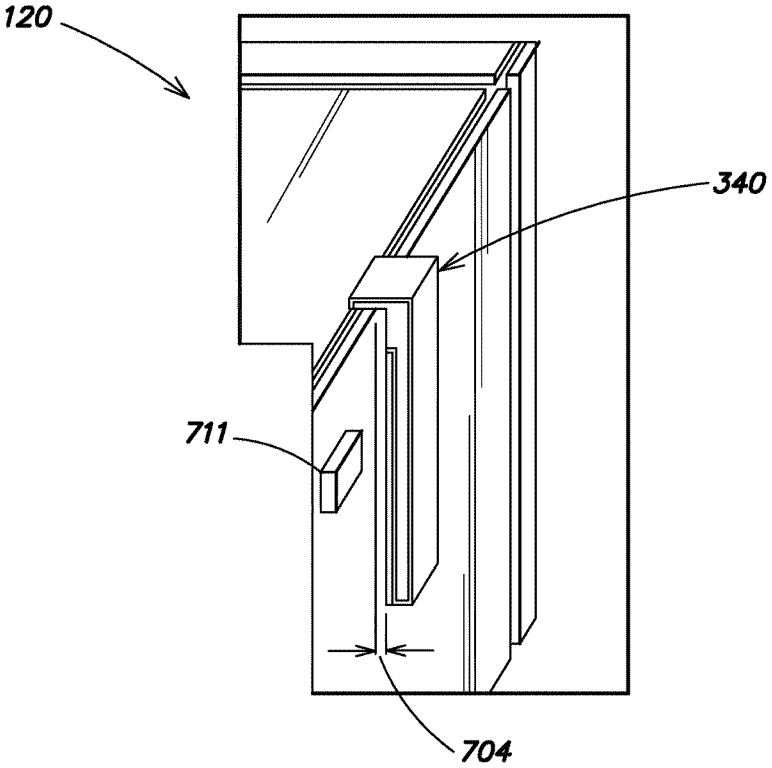
FIGS. 7A and 7B show tunable meander lines.
Figure 7A:
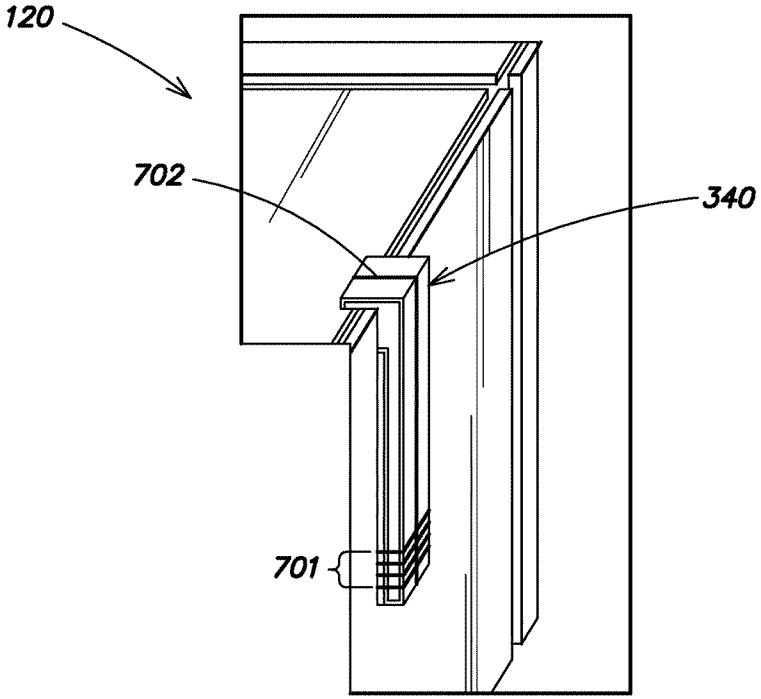

In an example shown in FIG. 7A, one or more switchable shorting paths 701 may be disposed along the body of the meander line 340, across a main conductor 702. By switching in different shorting paths, the meander line 340 may be tuned to different resonances. The meander line 340 may also be tuned in other ways. FIG. 7B shows one example of this where the size of a space 704 between the meander line 340 and an adjacent surface is adjusted with piezoelectric or other actuators 711.

The meander lines 340 may also be implemented using other frequency dependent structures such as the tunable Variable Impedance Transmission Lines (VITLs) described in U.S. Pat. No. 9,147,936 assigned to AMI Research and Development, LLC, hereby incorporated by reference.

Figures 8A, 8B:
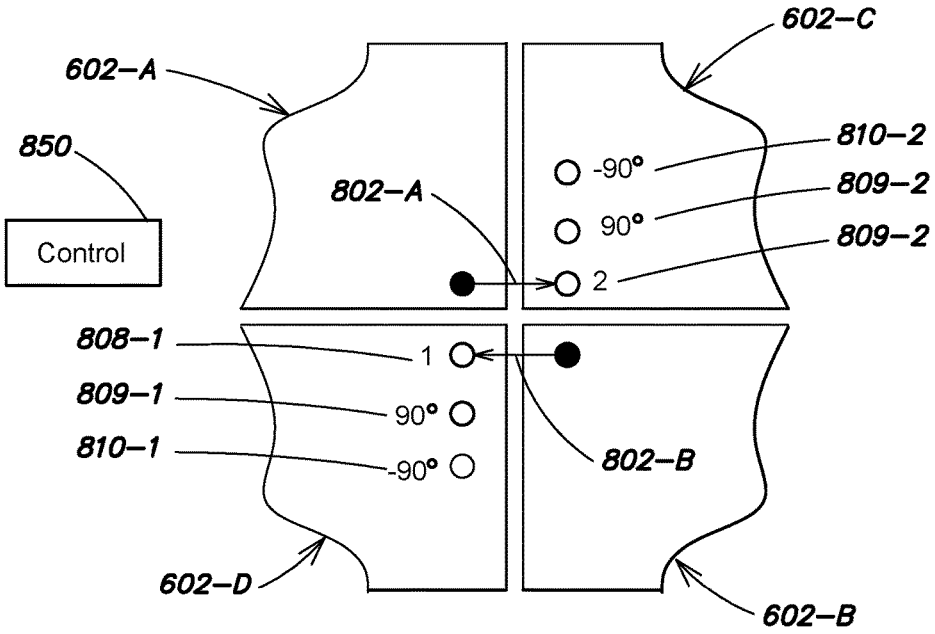
FIGS. 8A and 8B illustrate selectable polarization.

The line arrays may also provide different polarizations such as circular (either right-hand or left-hand), vertical, horizontal, or a combination of some or all of such polarizations. FIGS. 8A and 8B illustrate how different combining networks may be implemented to provide these different polarization modes. FIG. 8A is representative of the feed points of is a driven element 120-2. Shown are two crossed dipole patches 602-A, 602-B, and 602-C, 602-D. Switches 802-A and 802-B provide the ability to selectively control a first dipole (formed by patches 602-A, 602-B). These switches connect the feed points to different locations on the adjacent patches. For example, switch 802-A permits connecting the feed for patch 604-A to one of three different positions on adjacent patch 602-C including positions 808-2, 809-2 and 810-2, and a fourth position 808-1 on patch 602-D. Similarly, switch 802-B selectively connects the feed point on patch 602-B to one of three positions 808-1, 809-1 and 810-1 on patch 602-D or to point 808-2 on patch 602-C. Points 809-1 and 809-2 are connected to their respective patch through a 90° phase shifter. Points 810-1 and 810-2 are connected to the respective patch though a −90° phase shifter.

The table of FIG. 8B shows four different selectable positions for each switch 802-A, 802-B and the resulting polarizations, in the E-plane and H-plane.

For example, placing switch 802-A in position 2 (connecting it to point 808-2) and switch 802-B connected to position 1 (connecting to point 808-1) provides horizontal polarization in the E-plane and vertical polarization in the H-plane. With switch 802-A in position 808-1 and switch 802-B in position 808-2, the opposite horizontal and vertical polarizations are provided. Switch positions selected for the 90° phase shifters or −90° phase shifters provide, respectively, right-hand circular polarization or left-hand circular polarization.

FIGS. 8A and 8B thus illustrate how the driven elements 120-2 may be operated by a digital controller 850 to provide different polarizations. The parasitic elements 120-1 and 120-3 are similarly controlled by digital controller 850 (with the understanding the feed points A and B are not connected to driving circuitry).

Controller 850 may include digital logic circuits, a gate array, a programmable microprocessor, a digital signal processor, or other circuits that control the state of the switches 802.

In certain embodiments, the selection of vertical, horizontal, or circular polarization state may depend upon a detected operating environment. In one example, the controller 850 may try various possible polarizations in an initial mode. The polarization mode with the highest receive power is then selected by the controller 850 for subsequent operation. In other embodiments, the circular polarization may be selected when other sensors indicate that device 100 is in motion. Such an input may come from an accelerometer, GPS or other sensor that provides inputs to the controller 850. In another mode, a scan of different directions may be used to indicate that the device is in a multipath environment. For example, if strong signals are received from two or more directions, then the device can be operated as if it is in an urban environment. In that case, the vertical polarization mode may be enabled by the controller. However, if multipath is not detected, then horizontal polarization may be enabled.

Figure 8C:
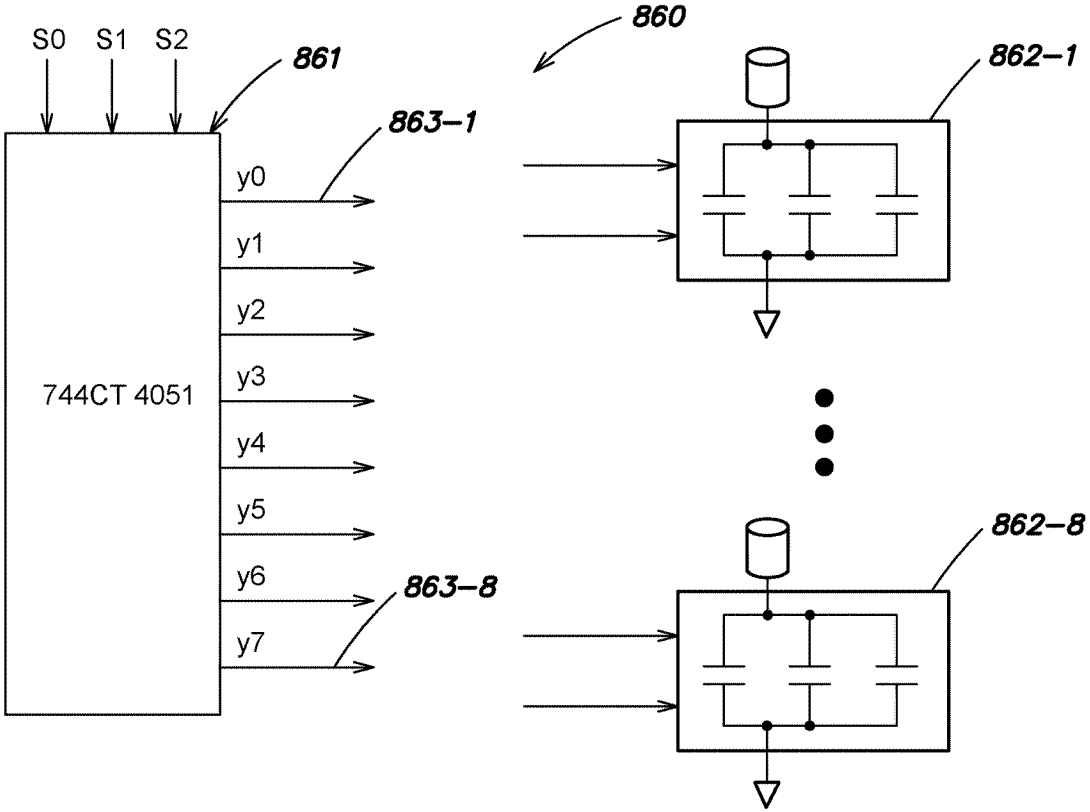
FIG. 8C is an example circuit for controlling whether a parasitic element is enabled or shorted out, to control direction of the array per FIGS. 2A and 2B.

FIG. 8C shows an example circuit 860 that controls capacitors 350 and thus controls the state of the eight parasitic elements thereby changing the beam direction. The capacitors are switched in and out to determine whether each parasitic element is enabled, or not, to thereby effect the beam patterns as shown in FIGS. 2B and 2C. Circuits 862-1, . . . , 862-8 may be a Digitally Tunable Capacitor (DTC) circuit such as a Peregrine™ PE64101. A DTC circuit 862 is provided for each of the top left, middle upper left, middle lower left, bottom left, top right, middle, upper right, middle lower right, and bottom right parasitic elements shown in FIG. 1.

Selector 861 may be a single pole, eight throw switch (SP8T) used as a demultiplexer to send outposts 863 to switch the respective DTCs 862 in or out of its circuit. Selector 861 takes three input digital bits S0, S1 and S2 and selects which one of the eight DTCs 862 is to be switched to a different state.

Parasitic arrays such as that in FIGS. 1 and 3 may, in some implementations, be vulnerable to human tactile effects. This may manifest itself as bandwidth limitations and/or other is degradation performance. In these environments, such as in hand-held mobile devices where the user's hand or head may be near the radiating elements, a driven array may provide more robust operation.

Figure 9C:
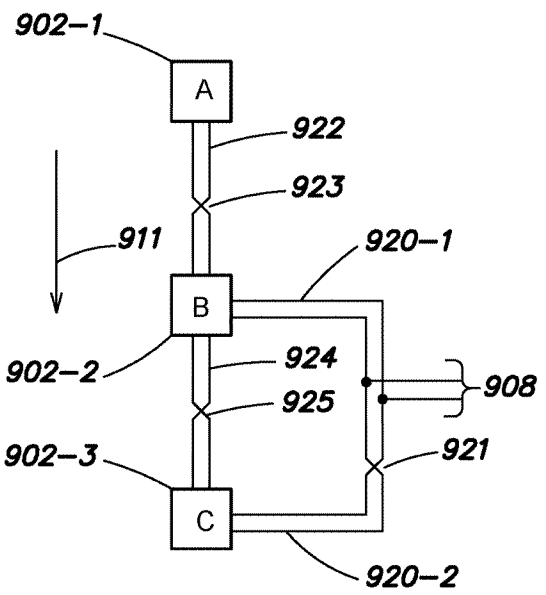
FIGS. 9A to 9G illustrate another embodiment using driven elements for each array section.
Figure 9B:
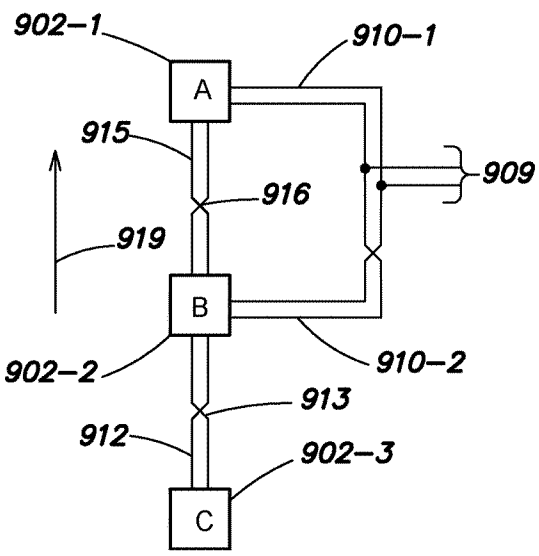
Figure 9A:
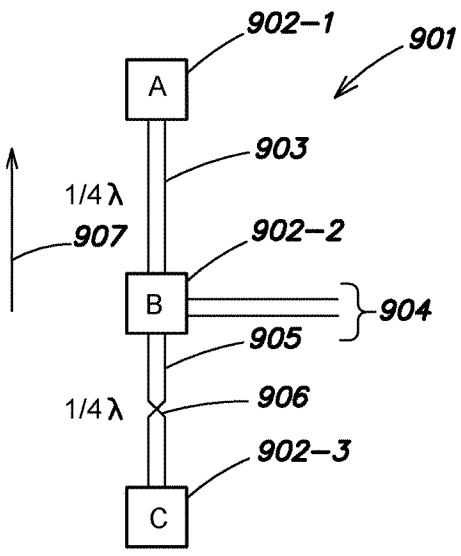

One configuration for three element line array where each element is a driven is shown in FIG. 9A. It is understood that this three element array 901 may be placed on each of the top, left, right, and bottom edges of a device housing 115 as was the case with the line arrays 110 described in connection with FIG. 1. In FIG. 9A, three unit cells 902-1, 902-2 and 902-3 are spaced apart by one-quarter wavelength. A main feedline 904 connects directly only to the center cell 902-2. Transmission lines 903 and 905 connect center unit cell 902-2 to the other unit cells 902-1, 902-3. In particular, upper unit cell 902-1 is connected via transmission line 903; lower unit cell 902-3 may be connected via a crossover 906 in transmission line 905. Crossover 906 reverses the polarity of the connection to the lower unit cell 902-3. This driven array 901 arrangement provides a main beam in the direction of arrow 907.

FIGS. 9B and 9C show an alternate to the arrangement of FIG. 9A. This configuration may provide greater bandwidth, even less sensitivity to tactile feedback, and greater freedom in packaging as it eliminates the need for one-quarter wavelength spacing. Again, there are three driven unit cells 902-1, 902-2, 902-3. The top cell 902-1 and center cell 902-2 are fed from point 909 out of phase via feedlines 910-1 and 910-2. Crossover 911 is provided at feedline 910-2. Bottom element 902-3 is also fed through a feedline 912 having crossover 913 from unit cell 902-2. Feedline 915 with crossover 916 connects cells 902-1 and 902-2. The configuration of FIG. 9B provides a main beam in the direction of the arrow 919. To provide a main beam in the opposite direction, the feedline configuration of FIG. 9C is used. Here, the center element 902-2 and bottom element 902-3 are driven at point 908 out of phase via transmission lines 920-1, 920-2 and crossover 921. The upper element 902-1 in this configuration may be driven from center element 902-2 through feedline 922 and crossover 923. Feedline 924 and crossover 925 couple cells 902-2 and 902-3; the resulting beam 930 is in a direction is opposite to the beam 919 generated by the FIG. 9B arrangement. The configuration of FIG. 9C may be provided using the same unit cells in FIG. 9B using sets of switches (not shown here for clarity).

Figure 9D:
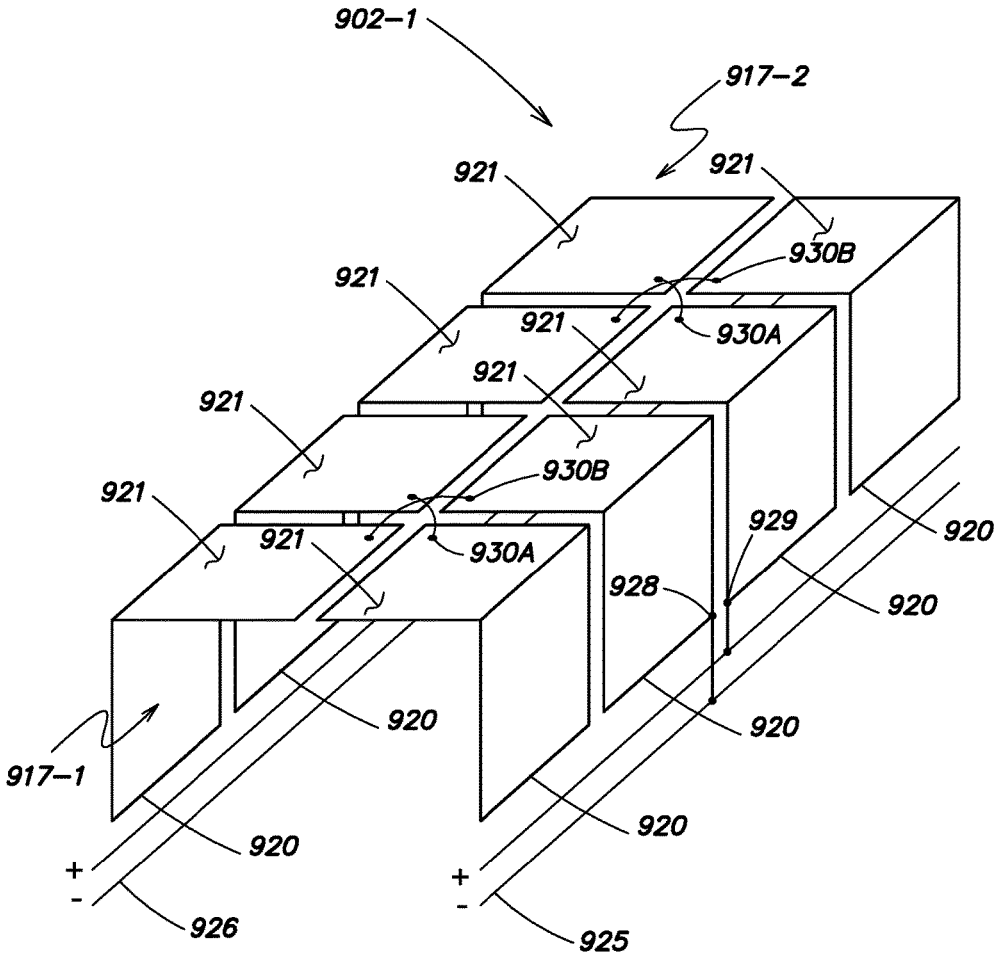

FIG. 9D is one configuration for the unit cell 902-1 in the embodiments of FIGS. 9A, 9B, and 9C. Here each unit cell actually consists of two sets of crossed dipoles or ORIANs. The first ORIAN radiator 917-1 consists of the four patches 921 and four patches 920 closest to the viewer; a second ORIAN 917-2 consist of the eight patches to the rear. Each ORIAN 917 thus consists of four patches 921 (shown on the top) and four patches 920 shown on the sides (it being understood that in this view the phone is placed on its edge with patches 920 near the front and rear face and patches 921 near the side). It is understood that the elements 920 and 921 may be a single patch of conductive material or may be two patches interconnected with meander lines and/or capacitances as in the FIG. 3 and FIGS. 6A to 6C embodiments. Feedline 925, 926 may be run along the bottom edge to points 928, 929. Pairs of A,B feedpoints 930-A and 930-B are provided for each ORIAN element, similar to that described above. While FIG. 9D shows an arrangement where each unit cell consists of a pair of ORIAN elements (each ORIAN in turn consisting of a pair of crossed dipoles) it should be understood that three or more sets of crossed dipoles could be used to implement each unit cell.

The idea behind the FIG. 9B (and FIG. 9C) arrangements is to generate two staggered cardiod patterns using signals A-B and B-C. The cardiods provide a high front to back ratio over a wide band. By feeding the cardiods out of phase, a wide band "FIG. 8" shape factor with 4-5 dBi of gain may be provided. The multiplication of the array factor by the cardiod pattern may result in a total gain of about 8-10 dBi, with high front to back ratio.

Figure 9E:
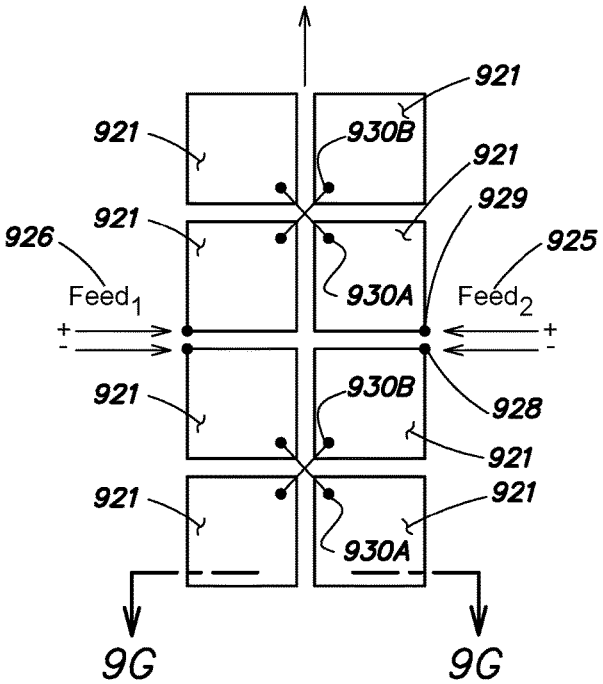
Figure 9F:
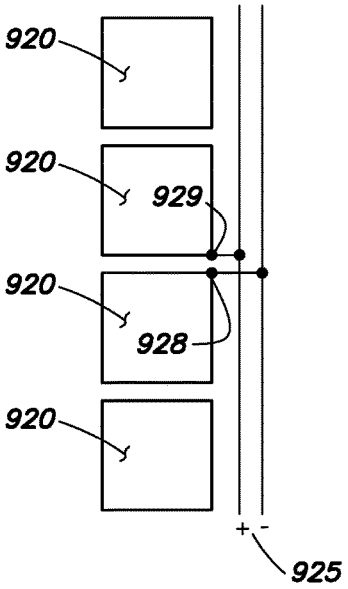
Figure 9G:
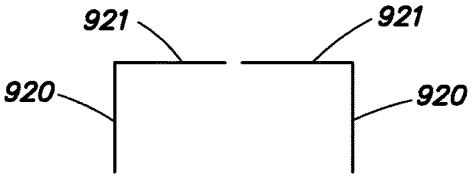

FIGS. 9E, 9F and 9G are side, top and cross sectional views, respectively, for the unit cell 902-1 of FIG. 9D. These views show the feedpoints 930-A, 930-B in more detail. The crossed dipole feedlines 925 and 926 are also shown.

FIG. 9G is a cross-sectional view of the unit cell, similar to that of FIG. 5, showing volumetric elements 920 and 921.

FIG. 9H is a table showing how the feedlines of FIG. 9E may be driven in phase, out of phase, or in quadrature, to provide vertical, horizontal polarization, right-hand circular or left-hand circular polarization. In this configuration, feedline 1 (926) serves as a main feed. Driving feedline 2 (925) with the same signals in phase provides a vertical polarization mode. This is the mode shown in FIG. 9E. Driving feedline 2 (925) with opposite phase provides a horizontal polarization mode. Driving feedline 2 (925) with respective 90° and −90° in quadrature provides either right hand polarization or left-hand polarization.

Figure 10:
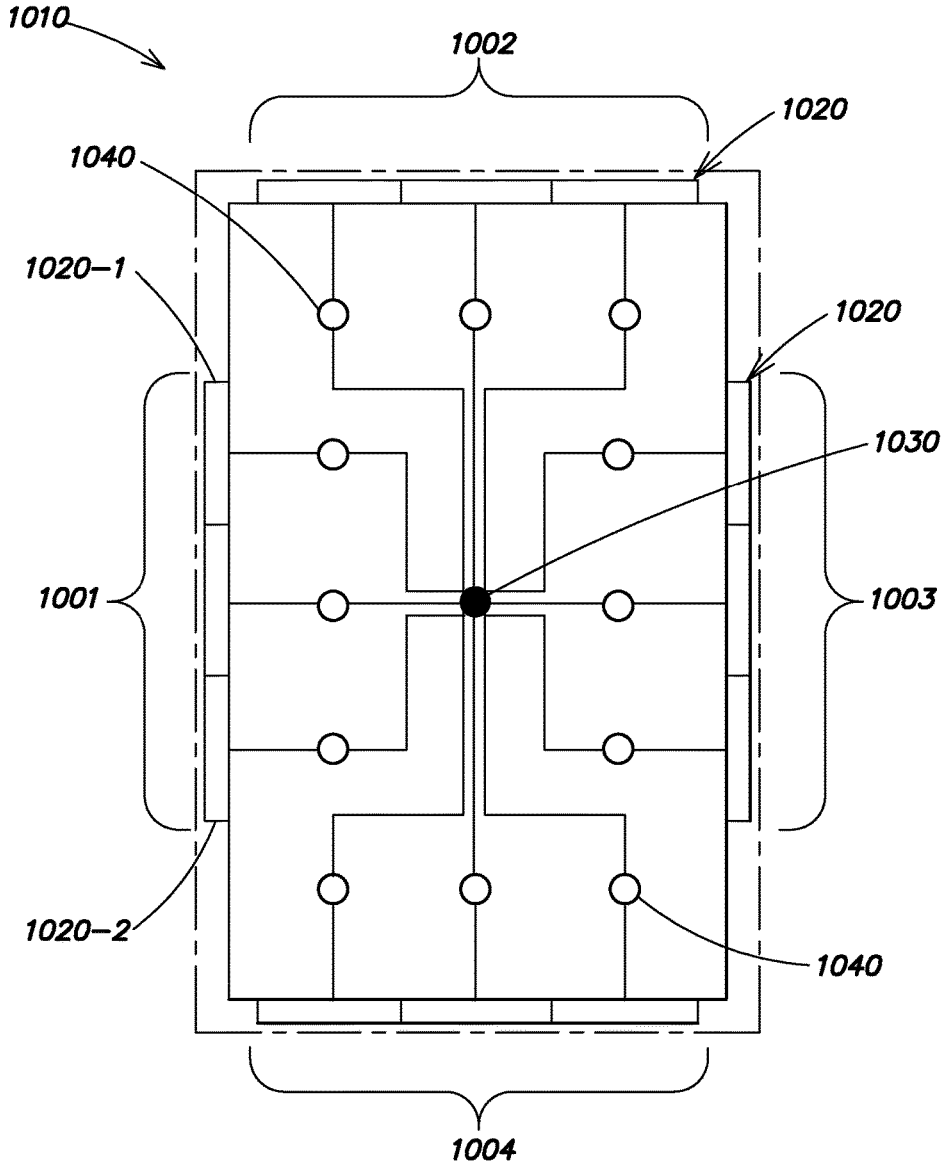
FIG. 10 is a schematic of a time delay beamforming mode.

FIG. 10 illustrates another implementation of an array that provides time delay beamforming. Here, array 1010 still includes four sets of line arrays 1001, 1002, 1003, 1004, with each line array consisting of three elements 1020. All elements 1020 are driven and there are no parasitic elements. For example, the configuration for element 1020-1 is the same as the configuration for element 1020-2. A single feed point 1030 connects through a respective delay 1040 disposed between the feed 1030 and each respective one of the elements 1020. The delays 1040 can be implemented in various ways, including a meander line, a VITL, or a transversal filter. The delays may also be provided by a Dielectric Travelling Waveguide Array (DTWA) as described in U.S. Pat. No. 9,166,301 assigned to AMI Research and Development, LLC. This arrangement, with the twelve elements each being actively fed, provides for a more focused beam, with increased bandwidth. This configuration also eliminates crossover between adjacent beams as might occur with the FIG. 3 embodiment. The delays 1040 can be placed in an outboard location near each radiating element 1020 (that is, along the edges of the housing). However in other embodiments, the delays 1040 be more centrally located such as nearer the feed point 1030.

It should be understood that the radiating elements of the FIG. 10 array may also be implemented with crossed dipoles as per FIGS. 6A and 6B, and driven with the various techniques as described in FIGS. 8A and 8B to provide a selectable horizontal, vertical and circular polarizations.

Figure 11:
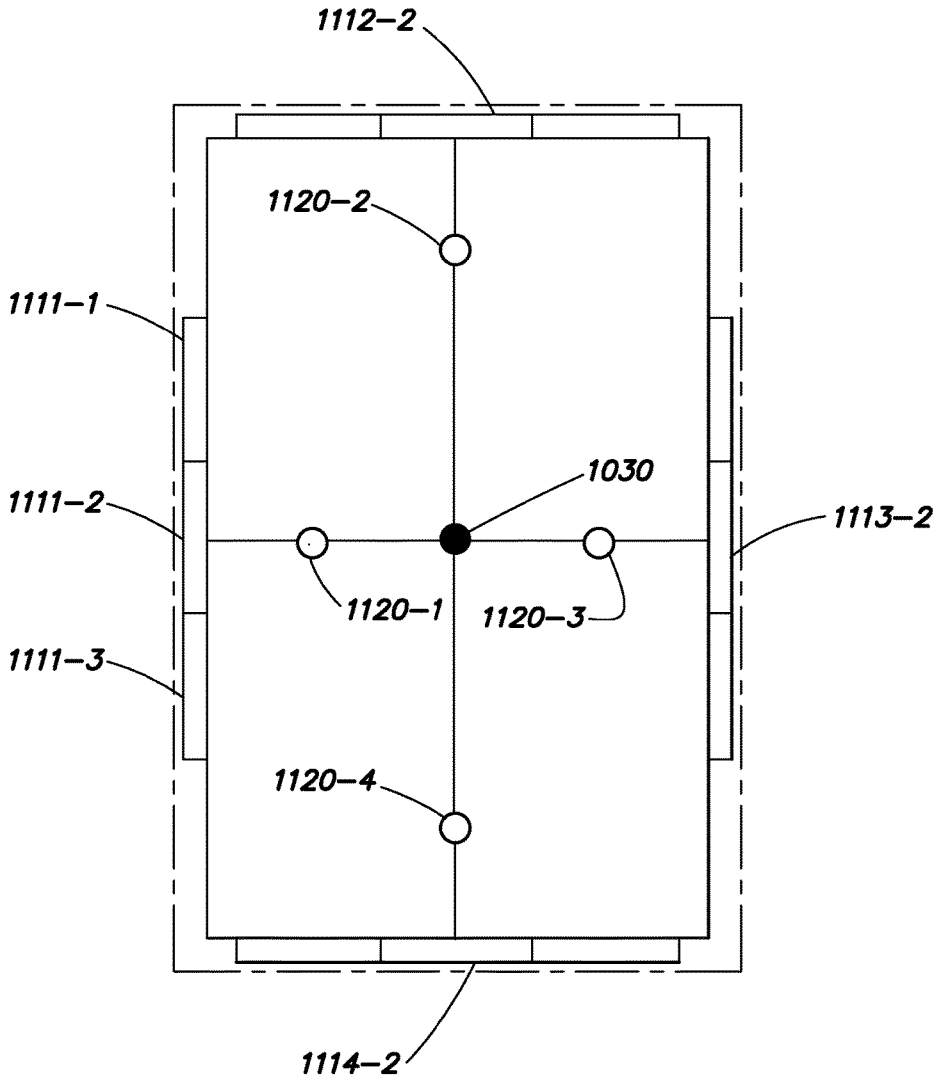
FIG. 11 is a schematic of another beamformer.

FIG. 11 illustrates another approach for beamforming as an alternate to FIG. 10. Here only the center elements 1111-2, 1112-2, 1113-2, 1114-2 are driven and the elements on either side thereof (such as elements 1111-1 and 1111-3) are parasitic. This implementation thus only uses four delays 1120-1, 1120-2, 1120-3, 1120-4 connecting to a central feed 1130. While providing less control over the resulting beam, this may be easier to implement than the FIG. 10 design.

Figure 12A:
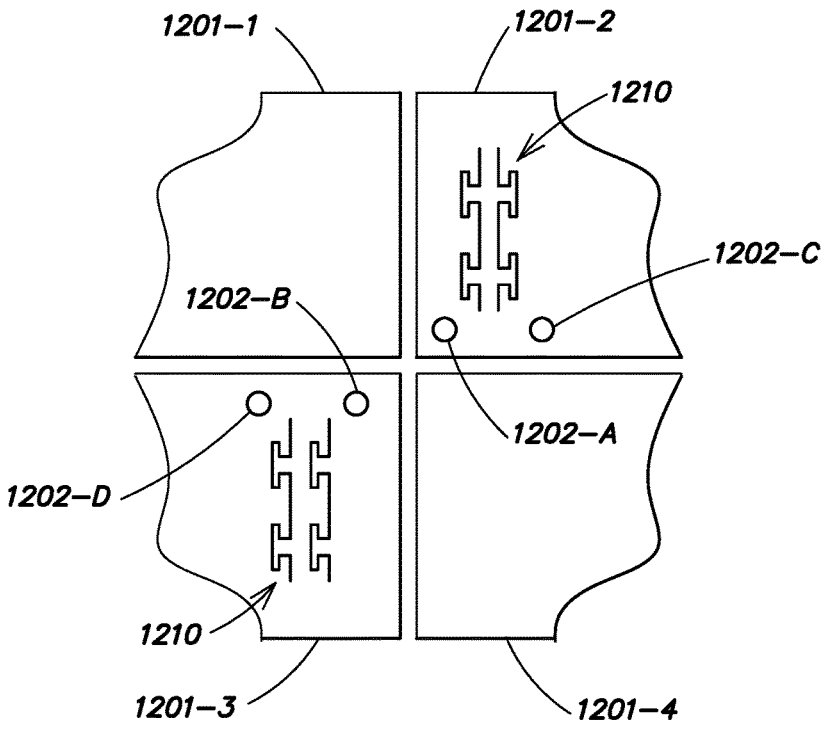
FIGS. 12A and 12B show selectable meander lines and a loop connection configuration, respectively.

FIG. 12A illustrates delay element configurations that might be used with the designs of FIG. 10 and FIG. 11. Crossed dipole, driven elements 1201-2 and 1202-3 include feed points 1202-A and 1202-B. One or more meander lines 1210 are coupled between feedpoint 1202-A and terminating point 1202-C which connects to the radiating patch. Similarly, meander lines 1210 are connected between feedpoint 1202-B and terminating point 1202-D. The meander lines 1210 provide another way to adjust the delay between the input feed and the respective radiating patches 102-2. Also note that there may be multiple meander lines individually switchable in an out of the circuit (switches not shown here for clarity).

Various configurations for the directional array may be used in the same device 100. For example, the controller 850 may place the array in a first mode with parasitic elements as described in FIGS. 2A, 2B, and 3, or with driven elements per FIGS. 9A,9B and 9C to obtain an initial rough estimate of direction. The array may then be switched to a beamforming mode, such as in FIG. 10 or 11, to provide a more narrowly focused beam.

Figure 12B:
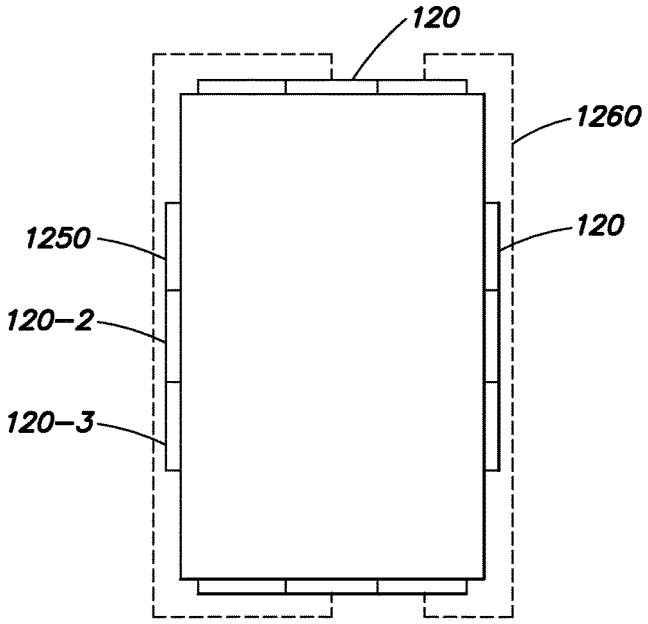

In yet another operational mode, switches may be disposed between array elements to connect them in one or more balanced feed line branches. These balanced feedline is branches 1250, 1260 might be combined with a set of couplers having an exponential taper such as shown in FIG. 12B. The tapered couplings provide equal power distribution to the various elements 120. In one embodiment, the balanced feedline may be provided from a Dielectric Travelling Waveguide Array such as shown in U.S. Pat. No.

9,166,301 assigned to AMI Research and Development, LLC hereby incorporated by reference.

Figure 13A:
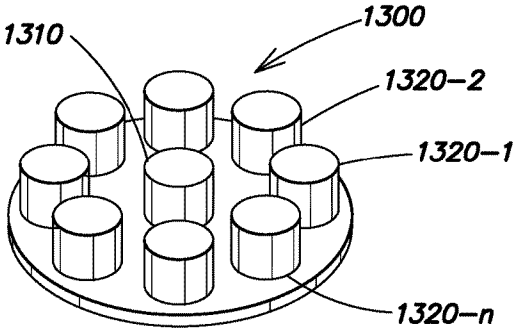
FIGS. 13A, 13B and 13C show various cylindrical element circular array configurations.
Figure 13C:
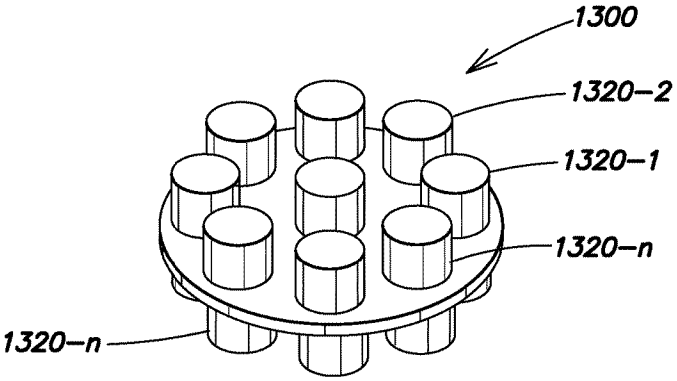
Figure 13B:
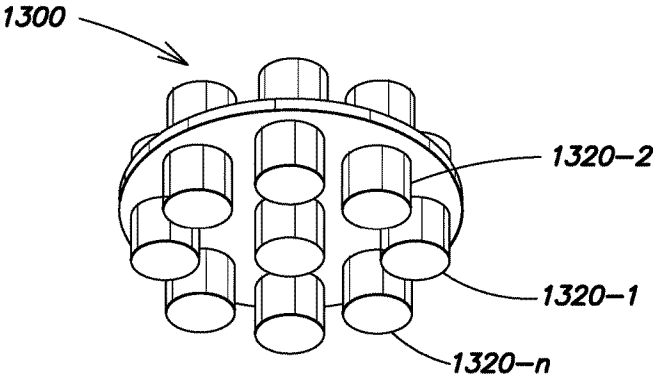

FIG. 13A illustrates another approach where the volumetric elements take the form of cylinders located in a circular array 1300. The cylindrical elements may be placed on one side (as per FIG. 13A) or both sides (per FIGS. 13B and 13C) of a substrate. This implementation may be of particular use for operation at frequencies in the 5G wireless bands (at 28 GHz, 37 GHz, 39 GHz and 64.71 GHz). The array 1300 consists of a center driven element 1310 surrounded by two or more parasitic elements 1320-1, 1320-2, **1320-*n*, . . . arranged in a circle about the center element 1310**. The parasitic elements may be controlled, as in the other implementations described above, to provide different polarizations or beamforming. In some implementations (not shown herein), the elements may be arranged in two or more circular arrays around a common center elements.

Figure 14:
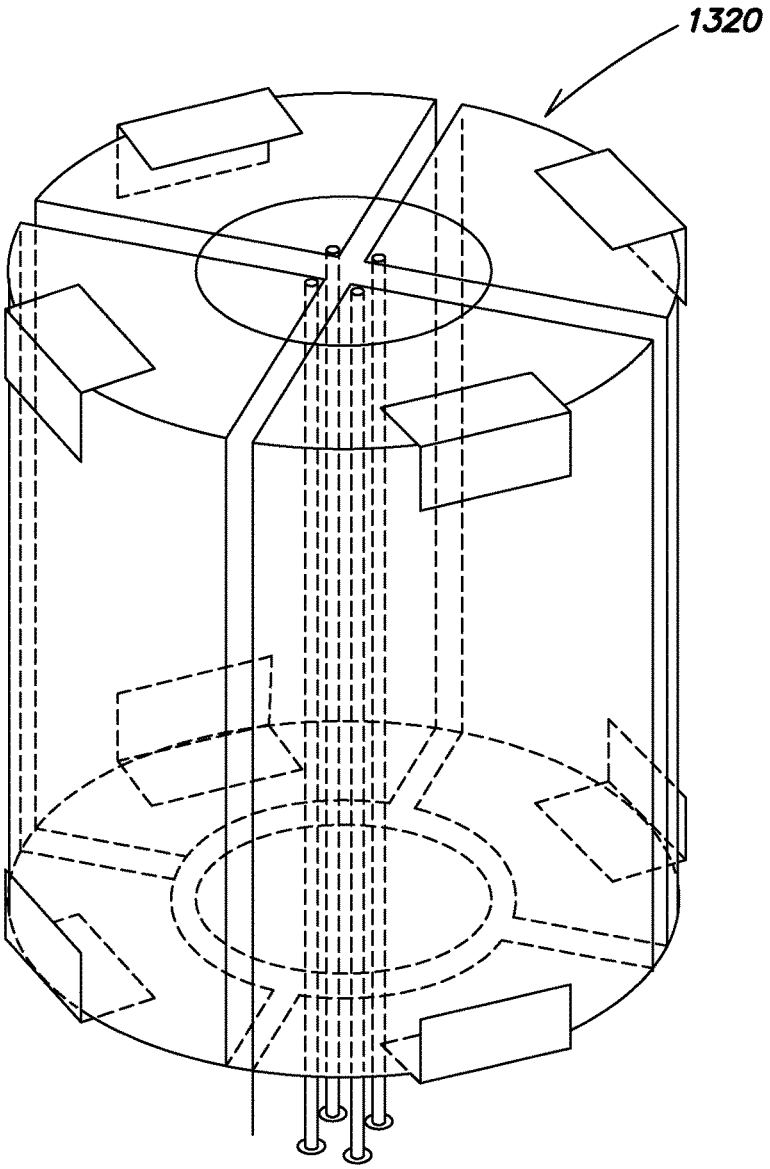
FIG. 14 is a detailed view of a cylindrical crossed dipole element.
Figure 15:
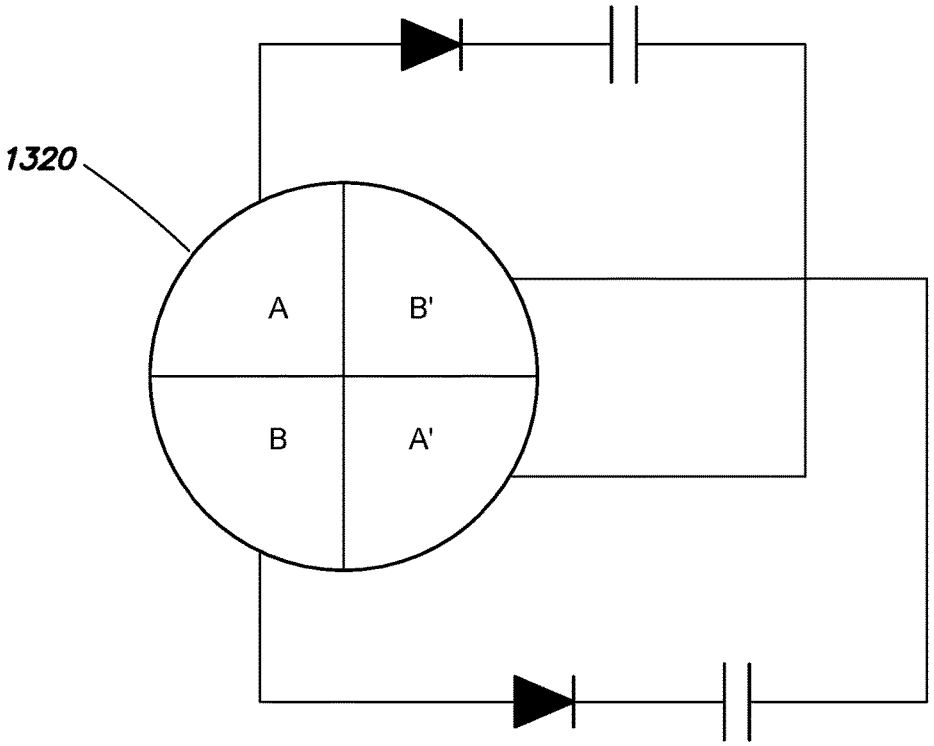
FIG. 15 is a circuit used with the cylindrical element of FIG. 14.

FIG. 14 is a more detailed view of one of the cylindrical elements 1310, 1320 which may include a pair of quadrant sections that provide a pair of crossed dipoles. This type of cylindrical, orientation independent (ORIAN) antenna element is described in further detail in U.S. Pat. Nos. 9,118,116 and 8,988,303 assigned to AMI Research and Development, LLC. FIG. 15 illustrates one possible way to combine the four quadrant feeds for a given parasitic element.

Figure 16:
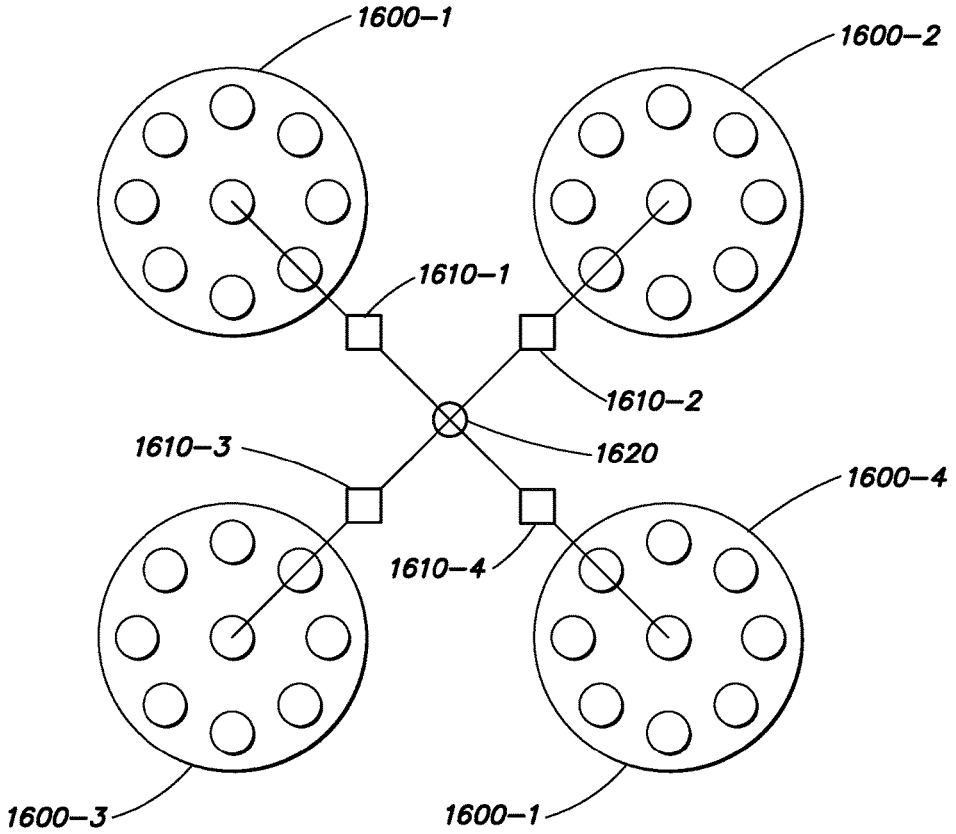
FIG. 16 shows an array of four circular sub-arrays.

FIG. 16 is another design utilizing the circular array 1300 of FIG. 13. In this design, four circular sub-arrays 1600-1, 1600-2, 1600-3, and 1600-4 are each configured in the same was as the circular array of FIG. 13. The center element of each of the sub-arrays are connected to a common feed 1620 through respective delays 1610-1, 1610-2, 1610-3, and 1610-4. The delay elements 1610 may be software controlled (such as by controller 850) is to provide further beamforming in a manner similar to that explained above. In this embodiment for operation at 5G wireless frequencies, the delays 1610 might be implemented as dielectric DTWAs rather than meander lines. The combination of four arrays 1600 gives greater control over the beam shape and direction.

Figure 17:
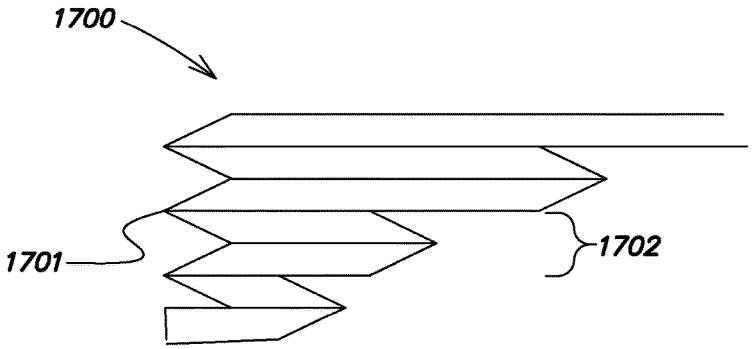
FIG. 17 is a folded meander line.

FIG. 17 is an implementation where the delay is provided by a folded dielectric travelling waveguide 1700. Folds 1701 in the dielectric provide different selectable waveguide lengths. Actuators or switches (not shown) provide control over the total delay introduced. In one example, the actuators may change the relative spacing between folds, or may switch delay sections such as section 1702 in or out.

Using one of the directive arrays described above within a handheld wireless communication device introduces the possibility of increasing the amount of radiation exposure to the user.

Figure 18B:
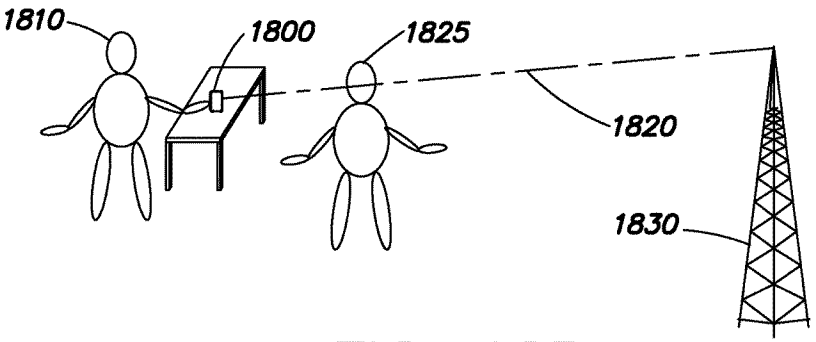
FIGS. 18A, 18B and 18C show how the directive array may be controlled.
Figure 18A:
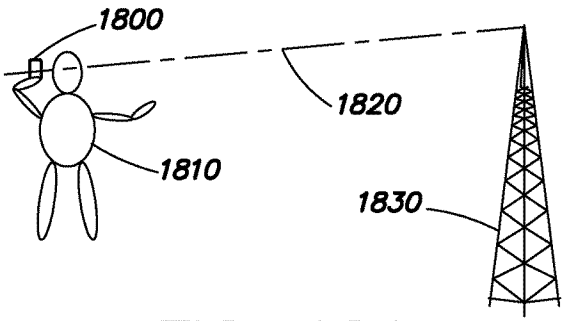

In one scenario shown in FIG. 18A, the user's head 1810 is completely or even just partially in line with a radiation path 1820 between a device 1800 and a destination transceiver such as a cellular base station (or WiFi access point, peered device, etc.) 1830. In this situation, if the device 1800 includes one of the directional antenna arrays described above, the device 1800 would determine the location of the tower 1830, chose path 1820 as the best direction, and focus most of the transmit energy with a directional beam through the user's head 1810. This may introduce an undesirable situation where the user is exposed to more than the usual amount of radiation.

FIG. 18B is another scenario where the device 1800 is placed on a table in front of its user 1810. Because of the relative position of destination 1830, another person 1820 on the opposite side of the table may be unnecessarily exposed to focused radiation, even though the second person 1825 is even further away from device 1800 than person 1810 who is operating the device 100.

Figure 18C:
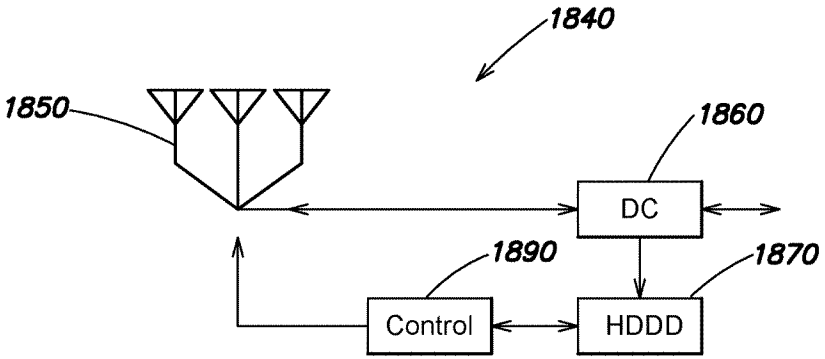

These situations can be alleviated with a particular method of operation and the circuit 1840 of FIG. 18C. The circuit 1840 may be fed off the antenna array 1850, which may be the one of the antenna arrays described above, or some other directional antenna. The array 1850 may be steered in at least two different directions. The outputs obtained at each specific direction are fed to a human density distribution detector 1870 through a directional coupler 1860. The density distribution detector 1870 may use any known technique to determine the presence of a nearby human. One technique detects a change in impedance in the near field by emitting a low frequency radio signal through antenna 1850 and observing a response. The response can then be analyzed to determine a so-called bio-impedance effect. In another approach, the density detector 1870 may be reflection-based. For example, detector 1870 may include circuits that determine that a Voltage Standing Wave Ratio (via SWR) mismatch is detected in a particular direction.

A controller 1890 thus operates to scan the array 1850 through a number of directions and determines a response from detector 1870 for each direction. In this way, the presence of a nearby human being and their relative position with respect to the device 1800 is known. The controller 1890 can then make a decision as to where the radiated power should be directed in order to reduce exposure to the nearby human(s). In particular, the controller 1890 may operate the array 1850 to change a direction of the beam away from the user's head if it is possible to do so and still reach the station 1830 with sufficient power. If that it is not possible, and the direction of the beam 1820 must pass through the user's head, then the power can be reduced and the array can be operated in an omnidirectional mode.

In yet another implementation, if a strong secondary response is detected from the station 1830, then the controller can determine that multipath is available (such as in an urban environment). In that case, the controller 1890 may enable only a secondary path for the directional array 1850 that is away from the user's head. In still other arrangements, the user may be prompted to move their head and/or move their device 1800 to a different location to reduce radiation exposure.

Figure 18D:
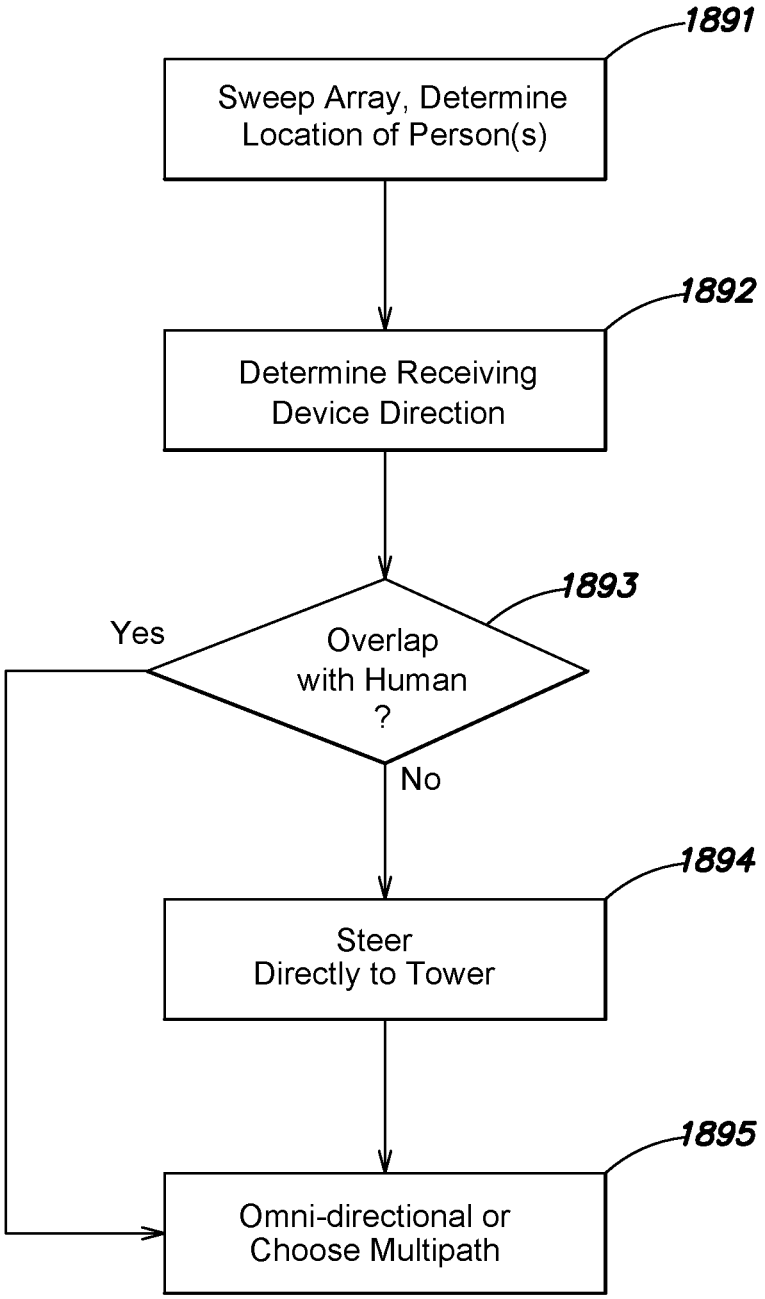
FIG. 18D is a flow diagram for the controller of FIG. 18B.

One process to control the array in this way is shown in FIG. 18D. In a first step 1891, the array is swept in order to determine the location of a human. In the next step 1892, which may occur before or after the first step 1891, a relative direction of the intended receiving device such as tower 1830 is determined. This can also be done by sweeping the array and determining a direction of the strongest receive signal, and/or by transmitting a signal and asking the destination 1830 to reply with a message containing directional information that station 1830 detects. Now having information about the location of the user 1810 and the location of the station 1830, in step 1893 the controller can thus now determine whether there is a possibility of the directional beam overlapping with the user 1810 or another nearby person 1820. If that possibility is low, in step 1894, the array 1850 is operated in a directional mode, the beam in the direction with maximum energy is enabled. Here, it can be assumed that it is safe to transmit with the directional beam. If there is an overlap between the idea direction data and a human's body, then either the power can be reduced in an omnidirectional mode, or a secondary detected multipath can be enabled.

If a human body is detected in the near field, and thus relatively close to the device 1800 as in FIG. 18A, the user may be prompted to switch the device to a different position. In one implementation, the user 1810 may be prompted to move the device 1800 to their other ear. This prompt can be indicated by a vibration or an audible signal. The proximity of the head can be determined by the human density detector 1870 or in other ways, such as by infrared or other detectors.

In some scenarios, the device 1800 may not be in close proximity to the person's head (in the rear radiation field of array 1850) but may be in the far field. For example, device 1800 may be located several feet away from the user on top of a desk at which the user is seated such as in FIG. 18B. In this situation, a directional signal may still be transmitted through a human body. To increase the range of density detection 1850, the device 1800 might purposely transmit at a lower frequency in order to increase the near field radius. In one example, the step of detecting the presence of a person may involve transmitting at a frequency of 700 MHz or lower to increase the range.

Figure 19:
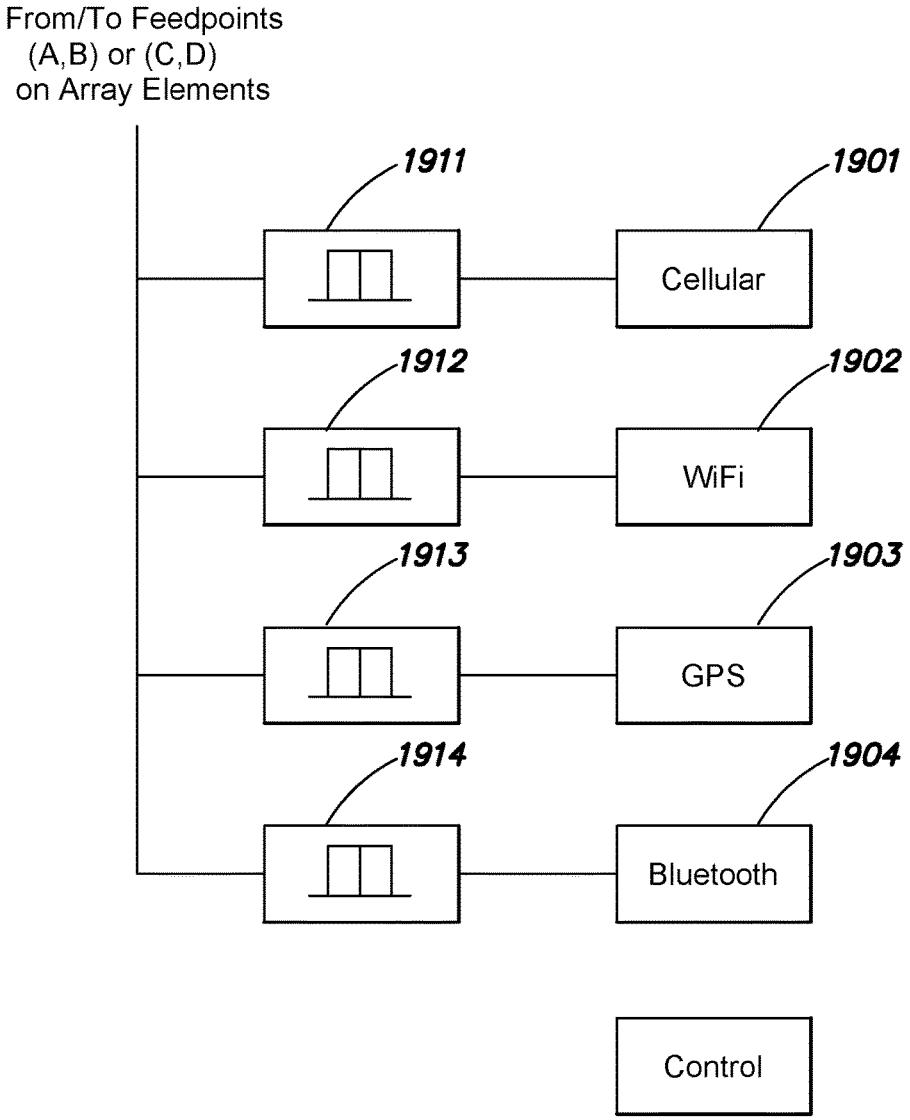
FIG. 19 illustrates separate beamformers for each of four operating bands.

The array of volumetric elements may also be configured with a separate beamformer for each desired operational frequency band. For example, as shown in FIG. 19, these may be a separate beamformer 1901, 1902, 1903 and 1904 for operating in respectfully, the cellular, Wi-Fi, GPS, and Bluetooth bands.

It may also be preferable to dispose bandpass filters 1911, 1912, 1913, 1914 for each band in line between the beamformer(s) and the array elements.

By inserting appropriate bandpass filters to pass only the respective cellular, GPS, Wi-Fi, or Bluetooth frequencies to or from the driven elements, it should be possible to steer a different beam for each frequency band using a single array. In this manner, multiple beams can be simultaneously generated, one for each operational band. The radiating patch or cylindrical elements may be sufficiently broadband in this configuration to cover the cellular, WiFi, GPS and Bluetooth bands.

Each beamformer 1901, 1902, 1903, 1904 may consist of a set of delay elements specific to its respective band of operation such as those described in connection with FIG. 10 or FIG. 11. In still other embodiments, it may also be desirable to provide different polarizations, and different combining networks as shown in FIGS. 8A and 8B (again, one each for each band).

Figure 20A:
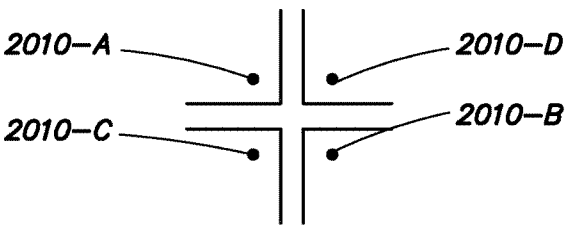
FIGS. 20A, 20B and 20C show a directive single element.

In another design variation, rather than using a line array of three elements depicted in FIG. 1, directional beams may be generated with a single patch used for each element. This is shown in FIG. 20A. Here a set of two crossed skewed dipoles elements may wrap around the edge of the device 100 as before. Feed points 2010-A, 2010-B, 2010-C, 2010-D are disposed on or adjacent the respective conductive patches, again as described is above.

Figure 20B:
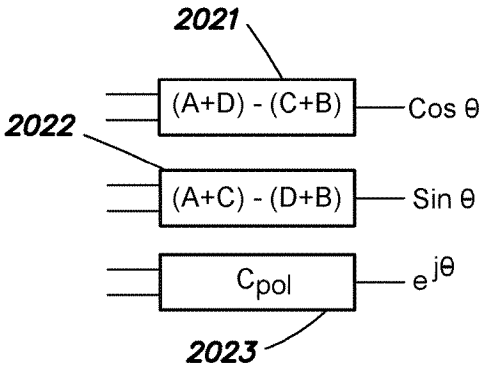
Figure 20B:
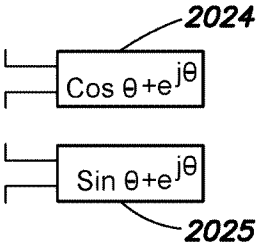

However, in an embodiment per FIG. 20B, a first combining network 2021 couples to feedpoints 2010 and produces a signal related to cos θ, where θ is the angle of incidence on the array. A second combining network provides a signal related to sin θ, where θ is again the angle of incidence on the array. A third combining network 2023 combines the feed points for a circular polarized detection mode (such as was described above in FIGS. 8A and 8B) to produce a signal related to $$\cos\theta + j\sin\theta = e^{j\theta}$$

Network 2024 adds the output of combining networks 2021 and 2023 to produce a signal related to $$\cos\theta + e^{j\theta}$$

and network 2025 combines the outputs of networks 2022 and 2023 to produce a $$\sin\theta + e^{j\theta}$$

signal.

Figure 20C:
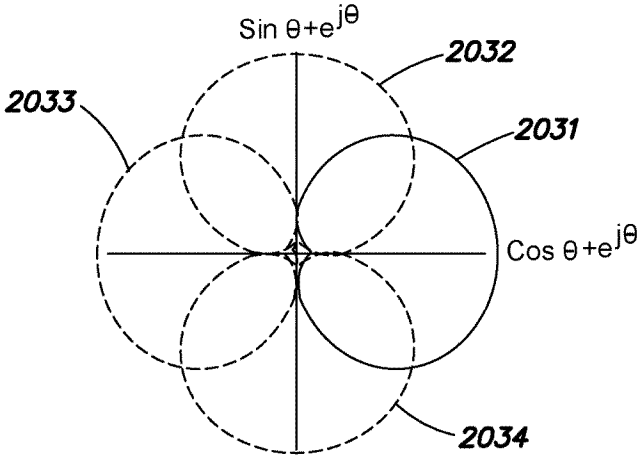

As shown in FIG. 20B, beams may then be generated in at least four directions by using the outputs of these networks in the manner indicated. For example, a beam 2031 in a direction with a main lobe pointed in a direction towards the right hand side of FIG. 20C may be generated by combining network 2024. Similarly, beam 2032 pointing in an upwards direction may be generated by combining network 2025. Beams 2033 and 2034 in two other directions may also be generated by difference combiners (not shown in FIG. 20B).

It should be understood that the embodiments described above are but examples and the various components may be implemented in many different ways. For example, the is component illustrations, block diagrams, circuit schematics, and network diagrams may include more or fewer elements, be arranged differently, or be represented differently. Accordingly, further embodiments may also be implemented in a variety of ways, and thus the components described herein are intended for purposes of illustration only and not as a limitation of the embodiments.

It should also be understood that the "processors" and "controllers" described herein may each be implemented by fixed digital circuits, programmable circuits, a programmable digital signal processor, or a physical or virtual general purpose computer having a central processor, memory, disk or other mass storage, communication interface(s), input/output (I/O) device(s), and other peripherals. The general purpose computer is transformed into the specialized, novel processors and executes the novel processes described above, for example, by loading software instructions into the processor, and then causing execution of the instructions to carry out the functions described.

Embodiments may therefore typically be implemented in hardware, firmware, software, or any combination thereof Embodiments may also be implemented as instructions stored on a non-transient machine-readable medium, which may be read and executed by one or more procedures.

A non-transient machine-readable medium may include any mechanism for storing or transmitting information in a form readable by a machine (e.g., a computing device). For example, a non-transient machine-readable medium may include read only memory (ROM); random access memory (RAM); magnetic disk storage media; optical storage media; flash memory devices; and others.

Furthermore, firmware, software, routines, or instructions may be described herein as performing certain actions and/or functions. However, it should be appreciated that such descriptions contained herein are merely for convenience and that such actions in fact is result from computing devices, processors, controllers, or other devices executing the firmware, software, routines, instructions, etc.

Thus, while this invention has been particularly shown and described with references to example embodiments thereof, it will be understood by those skilled in the art that various changes in form and details may be made therein without departing from the scope of the invention encompassed by the appended claims.

What is claimed is:

1. A wireless communication apparatus comprising:

a handheld, rectangular housing having a front face, a back face, and four sides; and a linear array of volumetric antenna elements disposed within the housing along each of the four sides; and wherein the volumetric elements each circumscribe a three-dimensional volume and the volumetric antenna elements each further comprise:

a first conductive patch surface aligned in parallel to a selected one of the four sides, a second conductive patch surface aligned in parallel to the front face, and a third conductive patch surface aligned in parallel to the back face, the second patch surface and third patch surface being symmetric such that the second patch surface has a same rectangular shape and dimension as the third patch surface.

2. The apparatus of claim 1 wherein each volumetric antenna element additionally comprises:

a meander line connecting the first conductive patch surface to at least one of the second or third conductive patch surfaces.

3. The apparatus of claim 2 wherein a capacitor is disposed between the meander line and at least one of the second or third conductive surfaces.

4. The apparatus of claim 2 wherein an electrical length of the meander line is controllable via one or more shorting lines.

5. The apparatus of claim 1 additionally comprising a Variable Impedance Transmission Line disposed between the first conductive surface and at least one of the second or third conductive surfaces.

6. The apparatus of claim 1 wherein the linear array of volumetric antenna elements further comprises a center driven volumetric element with a parasitic volumetric element disposed on either side of the center driven volumetric element.

7. The apparatus of claim 6 wherein the parasitic elements are controllable to be reflective or directive.

8. The apparatus of claim 1 wherein the linear arrays of volumetric antenna elements each comprise three driven elements.

9. The apparatus of claim 1 wherein each volumetric antenna element comprises two or more pairs of crossed dipoles.

10. The apparatus of claim 1 wherein the volumetric elements are selectively driven or parasitic to provide Multiple-Input Multiple-Output.

11. The apparatus of claim 1 wherein the volumetric elements further comprise four conductive surfaces connected to provide a pair of crossed dipoles.

12. The apparatus of claim 11 wherein the crossed dipoles further comprise a feedpoint disposed adjacent each of the four conductive surfaces, and the feed points are coupled to one another to selectively provide circular, horizontal, or vertical polarization.

13. The apparatus of claim 12 wherein the circular, horizontal, or vertical polarization is selected depending on a detected operating environment, such that vertical polarization is selected in an urban operating environment, horizontal polarization is selected in a rural operating environment, and circular polarization is detected when in an in-motion operating environment.

14. The apparatus of claim 1 additionally comprising:

a controller, for controlling a beam pattern of the array depending upon a detected spatial relationship among the device, a user, and a base station.

15. The apparatus of claim 14 additionally comprising:

a controller, connected to manipulate the beam pattern when the user is located between the device and the base station.

16. The apparatus of claim 15 wherein the controller operates the array in an omnidirectional mode when the device is located between the user and the base station.

17. The apparatus of claim 14 wherein the volumetric elements are selectively driven or parasitic.

18. The apparatus of claim 17 wherein the volumetric elements further comprise a center driven element and parasitic elements disposed on either side of the center driven element.

19. The apparatus of claim 17 wherein all of the volumetric elements located along the side are active and all of the elements located along one of the faces are parasitic, or all of the elements located along the side are parasitic and all of the elements located along one of the faces are active.

20. The apparatus of claim 1 wherein the volumetric antenna elements are further arranged as:

four quadrant radiators, each quadrant radiator comprising a feedpoint, one of the first conductive patch surfaces aligned with a side section and one of the second or third conductive patch surfaces aligned with either the front face or back face, with each quadrant radiator thus consisting of eight conductive patch surfaces, with four patch surfaces aligned with one of the four sides of the housing, two of the patch surfaces aligned with the front face, and two of the patch surfaces aligned with the back face;

a first pair of the quadrant radiators positioned opposite one another and symmetric along a major axis;

a second pair of the quadrant radiators positioned opposite one another and symmetric along the major axis; and a circuit for electrically combining the feedpoints of the quadrant radiators to provide a pair of crossed dipole radiators.

21. The apparatus of claim 14 wherein the volumetric antenna elements are further arranged as:

four quadrant radiators, each radiator comprising:

a feedpoint, one of the first conductive patch surfaces aligned with a side section and one of the second or third conductive patch surfaces aligned with either the front face or the back face, with each quadrant radiator thus consisting of eight conductive patch surfaces, with four patch surfaces aligned with one of the four sides of the housing, two of the patch surfaces aligned with the front face, and two of the patch surfaces aligned with the back face;

a first pair of the quadrant radiators positioned opposite one another and symmetric along a major axis;

a second pair of the quadrant radiators positioned opposite one another an symmetric along the major axis; and a circuit for electrically combining the feedpoints of the quadrant radiators to provide a pair of crossed dipole radiators.

22. The apparatus of claim 20 additionally wherein:

at least one edge of a patch surface aligned with one of the four sides of the housing is tapered to have a shorter dimension along the major axis than an outboard edge.

* * * * *